US008322349B2

(12) United States Patent
Prevost

(10) Patent No.: US 8,322,349 B2
(45) Date of Patent: Dec. 4, 2012

(54) CIGARETTE ROLLING AND FORMING DEVICES

(76) Inventor: David Prevost, Portland, OR (US)

( * ) Notice: Subject to any disclaimer, the term of this patent is extended or adjusted under 35 U.S.C. 154(b) by 1212 days.

(21) Appl. No.: 12/136,650

(22) Filed: Jun. 10, 2008

(65) Prior Publication Data

US 2009/0301501 A1 Dec. 10, 2009

(51) Int. Cl.
*A24C 5/00* (2006.01)

(52) U.S. Cl. ..... 131/70; 131/78; 131/56

(58) Field of Classification Search ..... None
See application file for complete search history.

(56) References Cited

U.S. PATENT DOCUMENTS

| | | | | |
|---|---|---|---|---|
| 338,580 | A | 3/1886 | Arnold | |
| 1,087,230 | A * | 2/1914 | Garwood | 131/47 |
| 1,909,749 | A | 5/1933 | Booth | |
| 1,956,838 | A | 5/1934 | Steuart | |
| 2,276,719 | A | 3/1942 | Daudelin | |
| D142,559 | S | 10/1945 | Herzog | |
| 2,436,015 | A | 2/1948 | Morris | |
| 2,471,656 | A | 5/1949 | Sas | |
| 3,783,882 | A * | 1/1974 | Messner et al. | 131/70 |
| 3,911,933 | A | 10/1975 | Crisp et al. | |
| 4,368,741 | A | 1/1983 | Meinunger | |
| 4,657,030 | A * | 4/1987 | Werding | 131/70 |
| D400,300 | S | 10/1998 | Brandenburg et al. | |
| D473,338 | S | 4/2003 | Brandenburg et al. | |
| D545,494 | S | 6/2007 | Soeprapto | |

FOREIGN PATENT DOCUMENTS

| | | | |
|---|---|---|---|
| GB | 385870 | A | 1/1933 |
| GB | 438583 | A | 11/1935 |
| WO | 2008059201 | A1 | 5/2008 |

OTHER PUBLICATIONS

Patent Cooperation Treaty, International Search Report for PCT Application No. PCT/US2009/046468, mailing date Jul. 24, 2009, 2 pages.
Patent Cooperation Treaty, Written Opinion of the International Searching Authority for PCT Application No. PCT/US2009/046468, mailing date Jul. 24, 2009, 12 pages.
Photos of prior art cigarette rolling device 1 (A-D).
Photos of prior art cigarette rolling device 2 (A-B).
Photos of prior art cigarette rolling device 3 (A-C).
Photos of prior art cigarette rolling device 4 (A-D).
Photos of prior art cigarette rolling device 5 (A-B) .

(Continued)

*Primary Examiner* — Michael J Felton
(74) *Attorney, Agent, or Firm* — Schwabe, Williamson & Wyatt

(57) ABSTRACT

Cigarette rolling and forming devices include parallel cylinders extending between a pair of support plates, and a looped belt trained therearound. One cylinder is moveable relative to the other for alternately receiving and compressing loose tobacco into a tobacco rod with the belt. In some devices, a pair of slots allows movement of the cylinder, and guard plates are disposed to prevent tobacco from the belt from entering the slots. Some devices include two pairs of slots and two moveable cylinders. Some devices include a support trough disposed to prevent sections of the belt from contacting each other. Some devices include a folding device configured to engage and fold the edge of a piece of paper received between the cylinders and rolled around the tobacco rod. Some devices include a nozzle to retain a pre-formed tube and a pushing device adapted to push a formed tobacco rod into the tube.

19 Claims, 9 Drawing Sheets

OTHER PUBLICATIONS

Photos of prior art cigarette rolling device 6 (A-B).
Photos of prior art cigarette rolling device 7 (A-D).
Photos of prior art cigarette rolling device 8 (A-B).
Photos of prior art cigarette roiling device 9 (A-E).
Photos of prior art cigarette rolling device 10 (A-C).
Photos of prior art cigarette rolling device 11 (A-E).
Photos of prior art cigarette roiling device 12 (A-E).

* cited by examiner

CIGARETTE ROLLING AND FORMING DEVICES

TECHNICAL FIELD

This disclosure relates generally to devices for making rolled cigarettes and more particularly to hand-operated devices for making rolled cigarettes one at a time.

BACKGROUND OF THE DISCLOSURE

Some cigarette smokers prefer the process of making their own cigarettes to buying pre-rolled and pre-packaged cigarettes. For example, the individual components of a cigarette, such as tobacco and cigarette papers, when purchased in bulk, are often less expensive per cigarette than pre-made cigarettes. In addition, some people find enjoyment in making their own cigarettes, and may even consider cigarette-rolling to be a challenging endeavor in which to demonstrate skill.

One way to make cigarettes individually and manually is to place an amount of loose tobacco in a cigarette paper and roll it between one's fingers. However, this approach is limited in that it is somewhat difficult to produce a cigarette of uniform shape and fill, and outside influences (for example, bad weather in an outdoor setting, or jostling from other people in a crowded area) may increase the difficulty.

Relatively small and simple devices that allow a user to make cigarettes are available; however, such devices small enough to fit comfortably in one's hand or on a table may not be capable of rolling consistently a high-quality cigarette. Other devices, though capable of improved function, may be too large to be carried easily in a pocket or handbag, if they may be carried at all.

Examples of rolling devices can be found in U.S. Pat. Nos. 338,580; 1,087,230; 1,909,749; 1,956,838; 2,436,015; 2,471,656; 4,368,741; D142,559; D400,300; D473,338; and D545,494, the disclosures of which are hereby incorporated by reference in their entirety for all purposes.

Such devices conventionally include a framework in which two roughly parallel rollers are closely arranged, and in which a looped belt is configured to encompass the rollers, with enough slack to form a groove or recess between the rollers in which loose tobacco may be formed into a cylindrical shape. Usually, at least one of the rollers is movable between two positions: an "open" configuration in which the rollers have their greatest separation, so that a broad, shallow recess in the belt between the rollers is formed, into which loose tobacco may be placed, and a "closed" configuration in which the rollers have their least separation, so that the belt forms a narrower and deeper recess, in which the loose tobacco may be compressed or shaped by movement of the belt over the rollers. In such devices, a piece of cigarette paper may then be fed between the rollers and rolled around the compressed tobacco to form a finished cigarette.

Different constructions are used to enable movement of the rollers relative to each other. In some devices, the ends of the movable roller may be journaled in a slot that defines a range of movement of the roller (relative to the other roller), as the ends are slid along the slot. In some devices, the moveable roller is mounted on a pair of hinged arms that may swing the moveable roller away from, or toward, the other roller. Some devices may include two pairs of arms on a central hinge, so that the rollers may be moved away from, or toward, each other by opening and closing the hinge.

Such devices, however, are prone to a number of difficulties in use, such as in manipulating the looped belt to form a cylinder of tobacco having a cigarette paper around it, rolling the rollers or otherwise smoothly moving the belt over the rollers to compress the tobacco, accumulating tobacco debris within the slots or openings holding the ends of the rollers, and binding of the looped belt as it passes through the device, and so forth. Further, such devices generally do not provide any means to compress the tobacco in either end of the formed cigarette, or fold the edge of the paper inward and over the end of the cigarette, such as to prevent the tobacco from falling out, for example if the cigarette is stored or otherwise is not immediately smoked. Each of these difficulties may result in a substandard manually-rolled cigarette, user frustration, mechanical failure, and so forth.

Also, such devices typically do not provide a mechanism by which a compressed cylinder of tobacco may be inserted into a pre-formed cigarette tube, for example if a user would prefer to use a pre-formed cigarette tube instead of a leaf of cigarette paper. Pre-formed tubes are commercially available, some of which include filter tips, which may be difficult to incorporate into a cigarette rolling device.

Instead, different types of injector machines are available, which operate by compressing loose tobacco in a chamber, and then forcing the compressed tobacco into a pre-formed tube. Typically, rods or corkscrew-like mechanisms are used to inject the tobacco into the tube, but such machines generally do not provide means by which the tobacco at the end of the tube is compressed, or by which the end of the tube may be closed, pinched, or otherwise manipulated to prevent loose tobacco from falling out of the formed cigarette. Also, such machines are generally too large and/or mechanically complex to allow portability.

SUMMARY

Several illustrative and non-exclusive embodiments of cigarette rolling and forming devices are disclosed, which generally include two (or more) cylinders and a looped belt trained thereon, and which are configured to selectively compress a quantity of loose tobacco into a shaped tobacco cylinder. Some embodiments are further configured to roll a piece of cigarette paper around the cylinder.

Some embodiments of cigarette rolling devices according to the present disclosure include one or more features that minimize or prevent mechanical clogging due to loose tobacco. For example, in some embodiments, a pair of opposing support plates extends from a base, with two cylinders extending between the support plates and rotatably mounted thereto. The support plates include a pair of corresponding slots, with axle portions of one of the cylinders being journaled therein for slidable movement, such the cylinder is translatably moveable relative to the support plates through a range of motion defined by the slots. Such embodiments further include guard plates disposed between the ends of the movable cylinder and the slot in which the axle portions are journaled, the guard plate being configured to prevent loose tobacco from the recess from entering the slot.

In such embodiments of cigarette rolling devices, a guard plate may include a movement slot through which the axle portion extends, the movement slot configured to accommodate a path of movement of the axle portion as the first cylinder is moved within the range of motion defined by the curvilinear slots. Optionally, the guard plate may be partially or wholly recessed in a corresponding recess in the support plate, or be otherwise disposed between the cylinder and the curvilinear slot.

Some embodiments of cigarette rolling devices according to the present disclosure include two cylinders that are both movable relative to the support plates. In such embodiments, each support plate includes first and second slots, with axle portions of each of the cylinders being journaled therein for slidable movement.

Some embodiments of cigarette rolling devices according to the present disclosure include a trough extending between and interconnecting the support plates, the trough having a top surface and a bottom surface, with the belt being trained around the cylinders and the trough, so that the portion of the belt forming the recess in which loose tobacco may be compressed is prevented from contacting other portions of the belt.

Some embodiments of cigarette rolling devices according to the present disclosure include a folding device disposed on one of the support plates that is configured to engage and fold the edge of a piece of paper received between the cylinders and rolled around the tobacco rod.

In such embodiments, the folding device may further include an impinger assembly mounted relative to an opening in the support plate. The impinger assembly in such embodiments may further include an impinger element that is selectively actuable to reversibly project through the opening and having a face configured, when the impinger element is projected through the opening, to engage and inwardly direct the edge of a piece of paper at least partially rolled around a tobacco rod. In some configurations, the impinger assembly may further be configured to engage and compress at least a portion of the end of a tobacco rod shaped in the cylindrical recess, thereby urging any paper between the impinger and the tobacco rod toward the tobacco rod. Optionally, the impinger assembly may further include a separate compression element configured to do this.

In embodiments that include a folding device, the folding device may optionally include, or take the form of, a deflection plate disposed on one of the support plates, the deflection plate further including a shaped surface defined by a peripheral edge, the peripheral edge being adapted to guide an edge of a piece of paper along the shaped surface as the paper is rolled around the tobacco rod, thereby deflecting the guided edge inward toward the tobacco rod as the paper is rolled around the tobacco rod.

In embodiments that include a folding device, the folding device may optionally include, or take the form of, a plurality of crimping elements adapted to reversibly project, from one or more directions transverse to the long axis of the substantially cylindrical recess formed by the portion of the belt between the cylinders, into the end of the recess adjacent to the support plate upon which the folding device is disposed. In such embodiments, the crimping elements may be configured, when projected, to engage and inwardly crimp the edge of a piece of paper at least partially rolled around a tobacco rod.

Some embodiments of cigarette forming devices according to the present disclosure include a pushing device mounted for movement along an axis parallel to the cylinders, the pushing device including a pushing surface adapted to engage and push one end of a shaped tobacco rod in the cylindrical recess toward one of the support plates. In such embodiments, the support plate may further include an opening and a nozzle disposed thereon, the nozzle extending in a direction away from the cylinders and being configured to receive and retain one end of a pre-formed tube against the plate. The pushing device may thus be adapted to selectively push the tobacco rod from the recess into a tube retained on the nozzle. In some embodiments, the pushing device may further be configured, after pushing the tobacco rod into the tube, to compress the tobacco rod into the tube.

These and other illustrative embodiments of cigarette rolling and/or forming devices may incorporate any combination of the features, components, and concepts discussed herein.

DETAILED DESCRIPTION OF VARIOUS EMBODIMENTS

Figure 1:
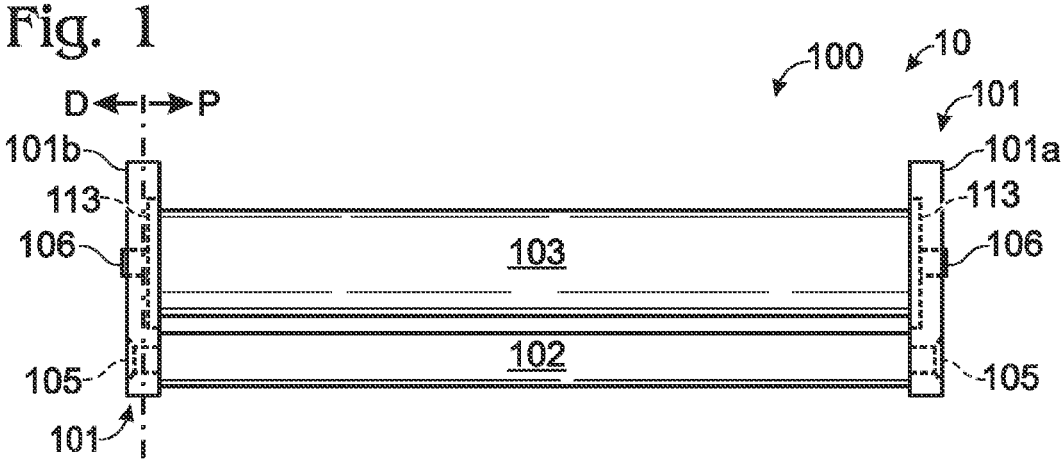
FIG. 1 is a front elevation view of a first embodiment of a cigarette rolling device.

Several illustrative, non-exclusive examples of cigarette rolling devices 10 according to the present disclosure are disclosed below in connection with FIGS. 1-47. As explained in more detail with respect to each embodiment, the illustrative embodiments differ from each other primarily in terms of different mechanical configurations and features. Alternative configurations and/or variants of several of the embodiments are also presented, such as to illustrate variations of structural components and arrangement of such components. The various embodiments, configurations, and methods disclosed in the paragraphs below are examples and should not be considered in a limiting sense, but merely for illustrative purposes of one or more of the aspects of the subject matter described herein. Numerous variations are possible and considered to be within the scope of this disclosure.

The cigarette rolling devices 10 in FIGS. 1-47 are illustrated in somewhat simplified form as including a base from which opposing support plates extend, with one or more cylinders extending between the support plates. As discussed, these devices may alternatively incorporate different support structures such as those variously described, illustrated, and/or incorporated herein or otherwise consistent with the present disclosure. Similarly, any of the following illustrative examples of rolling devices may be utilized with any or all of the described features or components, may have any suitable relative size and shape, and may be incorporated into a hand-held device or a larger mechanical system. It is within the scope of the present disclosure that components, subcomponents, and variants of the subsequently described FIGS. 1-47 may be used with other cigarette rolling devices within the scope of the present disclosure, such as those otherwise described and/or incorporated herein.

In FIGS. 1-47, various components and subcomponents of the cigarette rolling devices are indicated with similar reference numerals, but which are incremented in at least units of 100 to provide different reference numerals between different illustrative embodiments even though some or all of the embodiments may include the same components, sub-components and/or variants. As an example, reference numerals 100, 200, 300, etc. all indicate different embodiments of cigarette rolling devices 10 according to the present disclosure, reference numerals 101, 201, 301, etc. all indicate support plates; reference numerals 102, 202, 302, etc. all indicate bases; and so forth. For the purpose of brevity, each introduction of a new reference numeral for a previously described component or subcomponent will not include another full discussion or explanation that the component or subcomponent may include any suitable structure, such as which is described, illustrated and/or incorporated herein.

A first illustrative and non-exclusive embodiment 100 of a cigarette rolling device 10 is shown in FIGS. 1-5. This first embodiment 100 of a cigarette rolling device 10 includes a pair of support plates 101 (separately indicated at 101*a*, 101*b*) extending from a base 102, which is shown as a pair of horizontal crossbars interconnecting the two support plates, which in turn form the outer edges of the device. As a matter of convenience, the faces of the support plates are sometimes referred to herein as "proximal" and "distal," with "proximal" used herein to indicate "relatively closer to the center of the cigarette rolling device," and signified by P in FIG. 1, and "distal" indicating "relatively further from the center of the cigarette rolling device," and signified by D in FIG. 1. These conventions are used herein to describe the relative relationships between elements of all of the illustrated embodiments of the cigarette rolling device.

Figure 4:
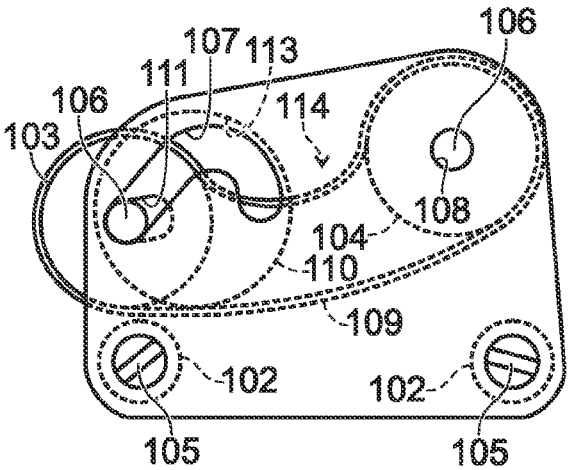
FIG. 4 is a side elevation view of the device of FIG. 1 in an open configuration.
Figure 5:
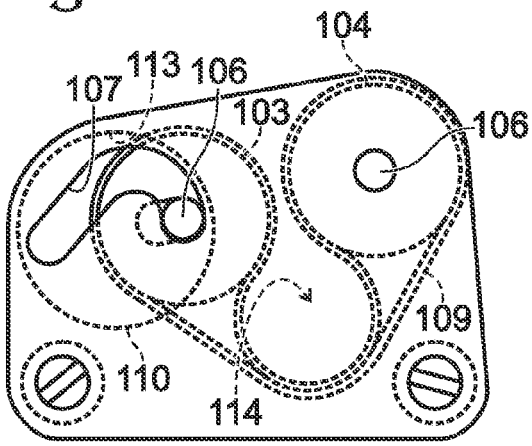
FIG. 5 is a side elevation view of the device of FIG. 1 in a closed configuration.

The support plates 101 are shown to be attached firmly to each other by way of crossbars, as shown also in FIGS. 4 and 5, which are connected to the support plates at anchor points 105, such as by screws or other mechanical linkages, or by any appropriate fastening means, to form a stable structure.

Figure 2:
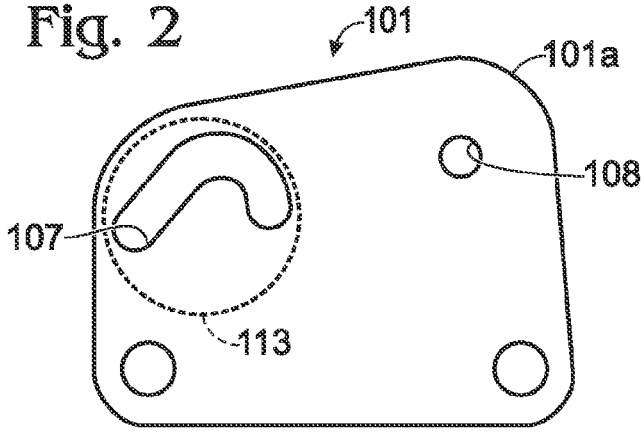
FIG. 2 is an elevation view of a support plate of the cigarette rolling device of FIG. 1.

Cylinders 103, 104 are shown to be mounted to, and extending between, the support plates. In the illustrative embodiment 100, each cylinder is shown to include axle portions 106 protruding in a longitudinal direction from the ends of the cylinder, the axle portions being mounted or otherwise rotatably coupled to the support plates. In particular, and as shown in FIG. 2, each support plate is shown to include a slot 107 in which the axle portions of cylinder 103 are journaled, and a mounting site 108 (shown as a hole) in which the axle portions of cylinder 104 are journaled. Slot 107 and mounting site 108 may allow cylinders 103 and 104, respectively, to be rotated relative to the support plates.

In device 100, mounting site 108 may allow cylinder 104 to be rotatable about a single, fixed axis defined by the placement of the axle portions relative to the support plates. As such, the mounting site may include any rotatable linkage; for example, instead of a hole through the support plate (as shown), a recessed portion into the proximal surface of the support plate may be used, or a stud or other mount that protrudes proximally from the support plate surface to rest within a corresponding depression-shaped axle portion on cylinder 103. Such variations are considered to be within the scope of this disclosure.

As shown in FIGS. 4 and 5, slots 107 allow cylinder 103 be selectively translatably moved relative to the support plates (and to cylinder 104), through a range of motion defined by the size and shape of the slots, by sliding the axle portions of cylinder 103 along the slots. Thus, cylinder 103 is configured to be rotatable about a non-fixed axis. As described in greater detail below, the inverted "J" shape of the slots shown in FIGS. 4 and 5 may provide stability when shaping a quantity of loose tobacco in a belt trained around the cylinders, such as by retaining the cylinder 103 in (or otherwise preventing or reducing inadvertent movement of the cylinder 103 from) a desired position in the slot, such as that shown in FIG. 5. As such, the slot may have any desired configuration. For simplicity, the slots in the illustrated embodiments are all shown to have a generally curvilinear configuration, and are referred to herein as "curvilinear slots" for convenience and clarity, such as to distinguish among other types of slots described herein. However, the slots may be curved, straight, or otherwise shaped, in various embodiments and alternative configurations of various embodiments, so the term "curvilinear slots" is not meant to be restrictive.

Further, some configurations may include a slot-shaped recess in the proximal surface of the support plates, instead of a slot through the support plates (as shown), or a slot that includes portions that extend all the way through the support plate and recessed portions, and so forth, and such variations are considered to be within the scope of this disclosure.

Rolling device 100 is also shown in FIGS. 4 and 5 to include a looped belt 109 trained around the cylinders. The belt is shown to be somewhat loose, with the portion of the belt disposed between the cylinders forming a recess, indicated at 114. As shown in FIGS. 4 and 5, this recess is relatively broad and shallow when cylinder 104 is spaced away from cylinder 103, and substantially cylindrical when the cylinders are substantially adjacent each other.

The overall structural configuration of a cigarette rolling device 10 having been explained, an illustrative explanation of the use of such a device, in general, is given in the paragraphs below. In the following explanation, several of the individual components are further discussed, as well as variations to the structural configuration and some components of the illustrated embodiments. All of such variations are considered to be within the scope of this disclosure.

In use, such as to roll a cigarette, a user may first move cylinder 103 away from cylinder 104, such as by applying force to the cylinder (or to the belt trained around the cylinder) sufficient to slide the axle portions in the slots so that the cylinders are spaced from each other in an "open" configuration, as shown in FIG. 4. As mentioned above, the configuration of the slot may be suitable to provide a desired amount of ease of movement of cylinder 103, such as by restricting or allowing freedom of movement along the slot; to provide a desired range of separation of the cylinders when cylinder 103 is moved near to or away from cylinder 104; and so forth. Thus, even though the slots in the illustrated embodiments are all shown, in general, to have an inverted "J" shape, any desired shape may be used.

A user may then place a quantity of loose tobacco on the portion of the belt between the cylinders, and prepare to shape the loose tobacco into a tobacco rod by moving the first cylinder toward the second, into a "closed" configuration, as shown in FIG. 5. Throughout the disclosure, the term "substantially adjacent" is used to describe the relative positions of the cylinders in this configuration, the term indicating that the cylinders are positioned close enough together so that loose tobacco placed in the recess shapes the recess into a substantially cylindrical form when the cylinders are urged into this configuration, but still spaced to provide sufficient clearance so that the portions of the belt trained over each cylinder do not come into contact when the belt is moved.

"Substantially cylindrical," in turn, signifies a shape with a relatively constant and substantially circular cross-section, such that a quantity of loose tobacco, when rolled in such a substantially cylindrical recess, is formed into a cylindrical shape, also referred to herein as a "tobacco rod." As can be seen in FIG. 5, the cross-section of the recess 114 when the cylinders are substantially adjacent is slightly teardrop-shaped, with the point of the teardrop extending to the space between the cylinders. However, the movement of the belt over the cylinders compresses any loose tobacco in the tip area into a cylindrical shape.

In general, a quantity of loose (uncompressed) tobacco sufficient to form a cigarette will occupy a greater volume than when compressed, and, when the cylinders are moved into the "closed" configuration, will urge the belt outward into the substantially cylindrical shape shown in FIG. 5. The size and cross-section of the cylindrical recess, for a given quantity of loose tobacco, may be determined by factors such as the length of the belt relative to the configuration of the cylinders, the elasticity of the belt, the size of the cylinders, and so forth, and as such, the belt (and the cylinders) may be configured as desired to provide a tobacco rod of desired dimension and/or desired compression. For example, the belt may be longer or shorter than as shown, and/or elastic or non-elastic, such as to form a differently-sized cylindrical recess in which the tobacco may be compressed.

After a quantity of loose tobacco is placed on the belt, and the cylinders have been moved to a "closed" configuration, the belt may be moved over the cylinders to shape the loose tobacco into a tobacco rod. As can be seen in FIG. 5, the portion of the belt forming recess 114 will "roll" the loose tobacco as the belt is moved over the cylinders, via the force exerted on the tobacco by the surface tension of the portion of the belt forming the cylindrical recess, and any surfaces against which the belt is urged (for example, the lower portion of the belt against which the cylindrical recess portion is slid, the surfaces of the cylinders, and so forth).

In the cigarette rolling devices illustrated herein, the cylinders (such as cylinders 103, 104) are all shown to be rotatably mounted to the support plates, and thus may be rolled in either direction to move the belt and compress the tobacco. As such, such cylinders may also be referred to herein as "rollers." Rotating the cylinders may allow easy movement of the belt over the cylinders. However, one or more of the cylinders may instead be nonrotatably mounted, for example in embodiments in which the belt may be slid over the one or more nonrotatable cylinders. For example, an alternative configuration may include a nonrotatable cylinder in place of cylinder 104, together with a rotatable cylinder such as cylinder 103, or any desired combination of rotatable and nonrotatable cylinders.

The surfaces of the cylinders thus may be textured to provide a desired degree of friction against the belt. The belt may also (or alternatively) have a textured outer and/or inner surface, such as to provide a desired degree of friction when moved over the cylinders and/or against the tobacco. In embodiments incorporating rotatable cylinders (or rollers), for example, the surface of the belt that is urged against the surface of the rollers may be textured or otherwise fabricated to assure a "grip" of the belt over the rollers, such that a user may be able to roll the rollers by exerting force on the belt. In embodiments incorporating nonrotatable cylinders or structures around which the belt is slid, the surface of the belt that moves against such cylinders may be smoothly textured or otherwise configured to reduce drag. Also, the surface of the belt that is urged against the tobacco may be textured or otherwise fabricated to "grip" the loose tobacco, such as to facilitate compression as the belt is rolled around the tobacco, as desired.

In configurations that incorporate nonrotatable cylinders, a "cylinder" may be configured to have a partially cylindrical or even geometrically noncylindrical shape, and consist of one or more surfaces over which the belt may be slid. Such surfaces may have a partially cylindrical or curved shape, such as to facilitate sliding, or any desired geometry to provide a sliding surface, and/or a surface against which the belt may be urged in order to compress a quantity of loose tobacco into a tobacco rod when the belt is moved over the cylinders. Such variations are considered to be within the scope of this disclosure, and, as such, are considered to be within the scope of the term "cylinder," as used herein. For the sake of clarity, however, all of the illustrated embodiments are shown to include rotatably mounted cylinders.

After the belt has been moved over the cylinders to compress the tobacco into a tobacco rod, a user may insert one end of a piece (or "leaf") of cigarette paper between the cylinders and continue moving the belt, to roll the paper received between the cylinders around the tobacco rod. Cigarette papers are commercially available in several standard sizes, and the overall width of the cylinders may be appropriate, in various embodiments, to accommodate leaves of various sizes.

Commercially available cigarette papers are usually gummed along one edge, or include some other adhesive property, so that when the gummed edge is oriented to be the trailing edge of the leaf as it is rolled around the tobacco rod, the gummed edge adheres to the surface of a portion of the paper already rolled. As such, if such a cigarette paper is used in the rolling device, a user may stop rolling and moisten the trailing, gummed edge prior to rolling the paper completely around the tobacco rod. Once the paper is rolled around the rod, the cylinders may be moved into the "open" configuration and the formed cigarette may be removed.

Figure 3:
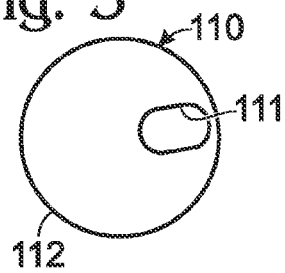
FIG. 3 is an elevation view of a guard plate of the device of FIG. 1.

Returning to the first illustrative embodiment 100 of cigarette rolling device 10, FIG. 3 shows a guard plate 110 that is disk-shaped, and includes a peripheral edge 112 and a movement slot 111 disposed between a central axis of the guard plate and the peripheral edge. FIG. 2 shows support plate 101*a*, which is shown to include a correspondingly shaped recess 113 on the proximal surface of the support plate, and indicated in dashed structure.

As shown, the size of recess 113 is large enough to encompass slot 107. Thus, as can be seen in FIGS. 4 and 5, guard plate 110 is seated within seated within recess 113, and disposed between the end of cylinder 103 and the curvilinear slot 107 in which the axle portion of the cylinder is journaled. The axle portion extends from the cylinder, through the movement slot, and is journaled in the curvilinear slot.

Recess 113 is configured to allow rotation of the guard plate relative thereto, with the movement slot 111 of guard plate 110 being configured to accommodate a path of movement of the axle portion as the cylinder 103 is moved within the range of motion defined by the curvilinear slot. The embodiment 100 of the device is shown to include two guard plates, one seated within each of support plates 101*a*, 101*b*, although in other configurations a device may include only one guard plate.

As can be seen in FIG. 4, about half of the curvilinear slot overlaps recess 114 in at least the "open" configuration and in at least part of the range of movement of cylinder 103. Loose tobacco typically includes a sufficient amount of moisture such that stray pieces of tobacco may have a tendency to stick to, clog, or otherwise interfere with moveable components of a cigarette rolling device, which may in turn interfere with intended operation and require periodic cleaning. As configured, however, the guard plate 110 of cigarette rolling device 100 is disposed between the end of the cylinder and the curvilinear slot, preventing loose tobacco from the recess from entering the slot, while allowing movement of the cylinder between open and closed configurations.

Guard plate 110 may thus be configured as desired to prevent loose tobacco from the belt, or more particularly from the recess formed by the portion of the belt between the cylinders, from entering the curvilinear slot, while accommodating movement of the axle portion as the cylinder is moved back and forth. In general, embodiments incorporating one or more pairs of curvilinear slots and one or more cylinders journaled for slidable movement therein, the shape of the guard plate, and/or the configuration of the movement slot in a guard plate, may relate to such factors as the shape and/or length of the slot, the relative size(s) of the moveable cylinder(s), and so forth.

In embodiments that include guard plates, the support plates may be configured as desired to include corresponding recesses such that the guard plates may be wholly or partially seated in the recesses. Optionally, some embodiments may include one or more guard plates that are not seated in a recess in a support plate at all, but are disposed between the support plate and the end of the cylinder, and are positioned to prevent loose tobacco from entering the curvilinear slot, such as by rotating relative to the adjacent support plate.

Additionally, guard plates may be of any desired thickness, and may be configured and/or oriented relative to the support plates in such a manner to facilitate movement of a cylinder relative to the support plates and/or rolling of the belt over the cylinders to shape a tobacco rod.

Figure 7:
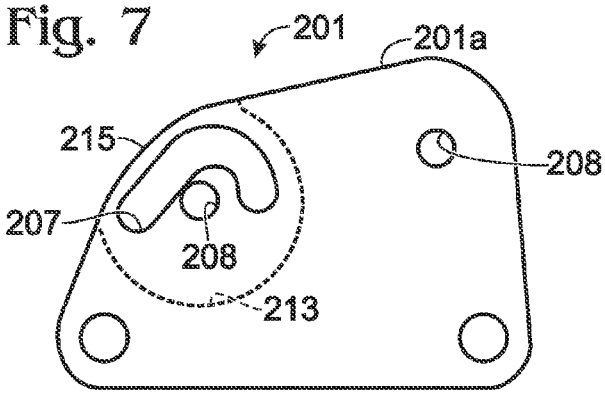
FIG. 7 is an elevation view of a support plate of the cigarette rolling device of FIG. 6.
Figure 8:
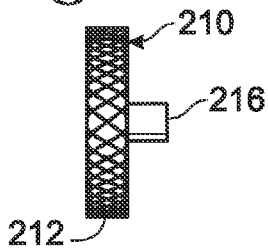
FIG. 8 is an elevation view of a guard plate of the device of FIG. 6.
Figure 9:
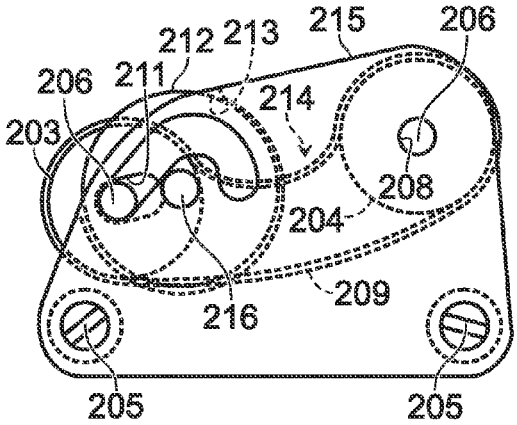
FIG. 9 is a side elevation view of the device of FIG. 6 in an open configuration.
Figure 10:
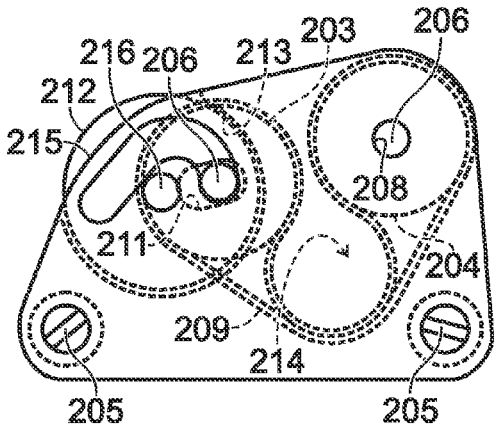
FIG. 10 is a side elevation view of the device of FIG. 6 in a closed configuration.
Figure 11:
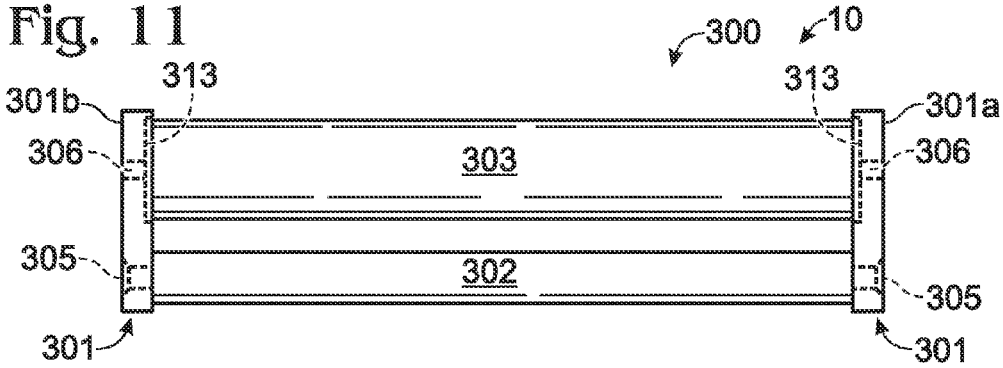
FIG. 11 is a front elevation view of a third embodiment of a cigarette rolling device.

FIGS. 6-10 show a second illustrative embodiment 200 of a cigarette rolling device that includes a pair of opposing support plates 201 extending from a base 202 consisting of horizontal crossbars interconnecting the support plates at anchor points 205. Cylinders 203, 204 extend between, and are rotatably mounted to, the support plates, with the axle portions 206 of cylinder 203 journaled in a curvilinear slot 207 for slidable movement therein, so that the moveable cylinder 203 may be moved between a spaced-apart position relative to the other cylinder 204 in an "open" position (as shown in FIG. 9) to a position substantially adjacent to cylinder 204 in a "closed" position (as shown in FIG. 10). A looped belt 209 is trained around the cylinders, with the portion between the cylinders forming a recess 214 adapted to receive a quantity of loose tobacco in the "open" configuration, and a substantially cylindrical recess in which loose tobacco may be shaped into a tobacco rod when in the "closed" configuration.

Figure 6:
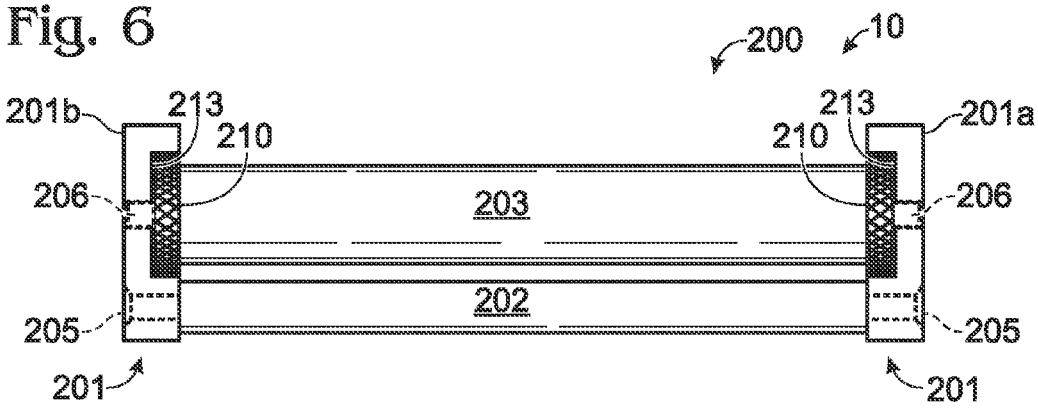
FIG. 6 is a front elevation view of a second embodiment of a cigarette rolling device.

As shown in FIG. 6, device 200 includes a pair of guard plates 210 (also shown in FIG. 8), each of which is disposed between an end of the moveable cylinder 203 and the curvilinear slot 207. As can be seen in FIG. 7, each support plate includes a partially circular recess 213 in which each guard plate may be at least partially seated. However, as shown most clearly in FIGS. 9 and 10, at least a portion of the peripheral edge 212 of guard plate 210 protrudes beyond a peripheral edge 215 of the support plate.

Guard plate 210 is also shown to include an axle portion 216, which is journaled within a mounting site 208 (shown as a hole) on the support plate 201*a*. In contrast to device 100, in which a guard plate is wholly seated within a recess in the support plate, guard plate 210 is only partially seated within corresponding recess 213. In other words, a portion of the guard plate extends beyond the peripheral edge 215 of the support plate. As such, axle portion 216 and mounting site 208 may provide rotational stability for the guard plate that may otherwise be provided, in other configurations, by wholly recessing the guard plate within a circular recess.

Guard plate 210 also includes a movement slot 211, through which axle portion 206 of cylinder 203 extends; as such, guard plate accommodates movement of the moveable cylinder while preventing loose tobacco from the recess from entering the curvilinear slot 207, similar to the configuration of guard plate 110 in device 100. Again, however, although two guard plates are shown, other embodiments of a cigarette rolling device may include only one guard plate, or even multiple guard plates, as shown in other illustrative embodiments herein.

In contrast to device 100, however, guard plate 210 in the embodiment 200 illustrated in FIGS. 6-10 includes a peripheral edge 212 that is at least partially knurled, as shown in FIG. 8, such as to aid manual manipulation of the device. For example, when the device is used, the knurled surface of the peripheral edge 212 of the guard plate 210 that protrudes beyond the peripheral edge 215 of the support plate may provide a surface that a user can manipulate to move cylinder 203 toward and away from cylinder 204. As shown in FIG. 9, rotational force applied to the knurled edge of the protruding portion of the guard plate 210 functions to rotate the guard plate on its axis, which carries or moves the cylinder 203 by exerting a pulling force (in this configuration) on axle portion 206 that is journaled in movement slot 211 of the guard plate. As the guard plate is rotated further about its axis, the axle portion 206 of the cylinder 203 is moved through the length of the curvilinear slot 207 until the cylinder is moved to the "closed" position shown in FIG. 10. From this position, it can be seen that rotating the guard plate in the opposite direction will move the cylinder back to the "open" position shown in FIG. 9.

As shown in FIG. 8, the entire peripheral edge of the guard plate is knurled. More particularly, the surface is shown to have a regular pattern of cross-cut grooves to provide a textured surface. However, as used herein, the term "knurled" refers to any regular or irregular arrangement of textural variations that aid in gripping, such as a series or one or more groupings of ridges, grooves, other shapes, and so forth, that may entirely or partially cover the surface of the peripheral edge.

In the illustrated configurations, the guard plate rotates only through a portion of a full, 360-degree rotation as the cylinder is moved through the range of motion defined by the curvilinear slots. In such configurations, then, only a corresponding portion of the peripheral edge of the guard plate may be knurled (in particular, the portion of the edge that protrudes beyond the edge of the support plate as the cylinder is moved through its range of motion), as opposed to the entire edge. Optionally, one or more portions of the peripheral edge of the guard plate may be raised, or protrude further from the edge of the guard plate, and as such may include a tab, knob, lever, or other protrusion that may facilitate the use of the guard plate as, for example, a thumbwheel to move the cylinder back and forth, as well as function to prevent loose tobacco from entering the curvilinear slots in the support plate.

Additionally or alternatively, the profile of the corresponding support plate may be configured, in such embodiments, to expose or present a portion of the peripheral surface of the guard plate. As can be seen by comparing support plate 101*a* in FIG. 2 with support plate 201*a* in FIG. 7, the latter includes a profile that exposes about one-quarter of the peripheral edge of the corresponding guard plate. Other embodiments may include support plates with shaped cut-outs or other edge profiles to expose a greater or lesser portion of the guard plate edge.

Although the discussion of illustrative embodiments 100 and 200 of cigarette rolling devices 10 above have focused on configurations that include one moveable cylinder, alternative configurations may include two moveable cylinders. One such configuration is shown in a third illustrative embodiment 300 of a cigarette rolling device 10, which is shown in FIGS. 11-14. Device 300 includes a pair of opposing support plates 301 extending from a base 302 that consists of horizontal crossbars interconnecting the support plates at anchor points 305. Cylinders 303, 304 extend between, and are rotatably mounted to, the support plates, with the axle portions 306 of each cylinder journaled in one of two pairs of corresponding curvilinear slots 307 in each support plate for slidable movement therein. As with embodiments 100 and 200, the configuration of the curvilinear slot determines a range of movement of the corresponding cylinder. In its range of movement, each cylinder thus may be moved between an "open" position in which the cylinder is at its furthest position relative to the other, and a "closed" position in which the cylinder is at its nearest position relative to the other.

Figure 13:
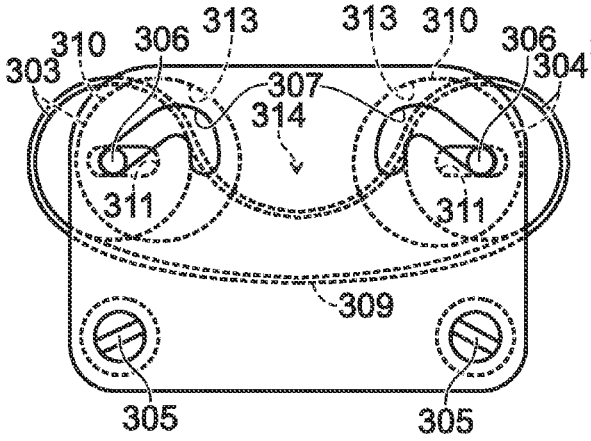
FIG. 13 is a side elevation view of the device of FIG. 11 in an open configuration.
Figure 14:
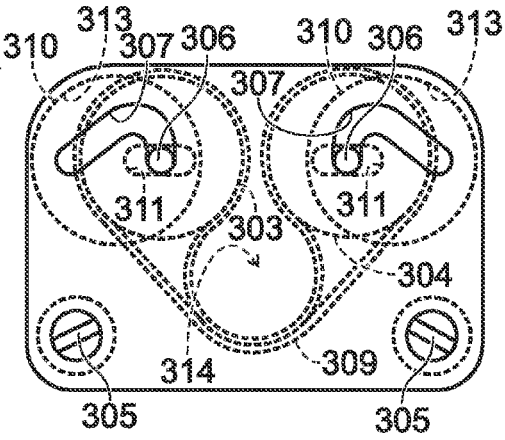
FIG. 14 is a side elevation view of the device of FIG. 11 in a closed configuration.

As a matter of clarity, the terms "open position" (or "first position") and "closed position" (or "second position") have been used in preceding discussion to refer to the position of the moveable cylinder relative to other components of the rolling device (such as the support plates, or the curvilinear slots, and so forth), whereas the terms "open configuration" and "closed configuration" have been used to refer to the relative positions of the cylinders with respect to each other. In embodiments that include one moveable cylinder, when the moveable cylinder is in an "open" position, the device (and the pair of cylinders) is thus in an "open" configuration. However, in embodiments that include two moveable cylinders, the term "open configuration" refers to the configuration when both cylinders are in the "open" position. For example, FIG. 13 shows device 300 in an "open" configuration, with both cylinders 303, 304 in an "open" position. Correspondingly, the term "closed configuration," when referring to an embodiment that includes two moveable cylinders, refers to the configuration when both cylinders are in the "closed" position. FIG. 14 shows device 300 in a "closed" configuration, with cylinders 303, 304 in a "closed" position. For convenience, the configuration when only one of the cylinders is in an "open" or "closed" position may be referred to as an "intermediate" configuration. In any case, these terms are simply meant as a matter of convenience to describe relative positions of some of the components of the various embodiments, and are not considered to be used in a limiting sense. For example, alternative embodiments of the devices may include curvilinear slots or other mechanisms to allow movement of one or more cylinders among a variety of positions, any of which may be referred to as "first," "second," "open," "closed," and so forth.

Figure 12:
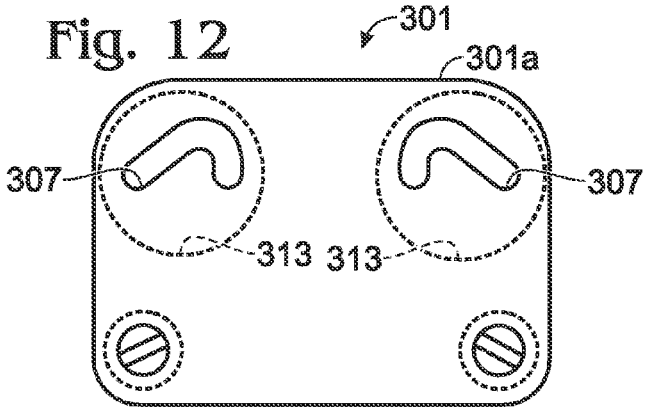
FIG. 12 is an elevation view of a support plate of the cigarette rolling device of FIG. 11.

Returning to FIGS. 13 and 14, a looped belt 309 is trained around the cylinders, with the portion between the cylinders forming a forming a recess 314 adapted to receive a quantity of loose tobacco in the "open" configuration, and a substantially cylindrical recess in which loose tobacco may be shaped into a tobacco rod when in the "closed" configuration. As also shown in FIG. 12, embodiment 300 includes symmetrical placement of the slots and the cylinders with respect to a central, vertical plane. The recess formed by the belt in this embodiment may thus be broader and/or shallower relative to configurations that include one moveable cylinder. Such a configuration may thus facilitate easier cleaning of the belt, such as to remove bits of loose tobacco, between uses. Optionally, a comparatively broader recess in an open configuration may allow the overall size of the device to be reduced without also reducing the size of the recess to a size that may be inconvenient for manual loading and/or cleaning.

Device 300 is also shown to include guard plates 310 for each curvilinear slot 307, with each support plate 301*a*, 301*b* including a pair of circular recesses 313 in which the guard plates are seated for rotatable movement therein. Guard plates 310 each include movement slots 311 through which the axle portions 306 of the cylinders extend. As in previous embodiments, the guard plates accommodate movement of cylinders while preventing loose tobacco from the recess from entering the curvilinear slots.

FIGS. 15-18 show another illustrative embodiment 400 of a cigarette rolling device having two moveable cylinders. Device 400 includes support plates 401 extending from a base 402 that interconnects the support plates at anchor points 405. Two moveable cylinders 403, 404 are mounted for rotatable and translatable movement relative to the support plates by means of axle portions 406 journaled in curvilinear slots 407. A looped belt 409 is trained over the cylinders such that a recess 414 is formed by the portion of the belt between the cylinders.

Figure 15:
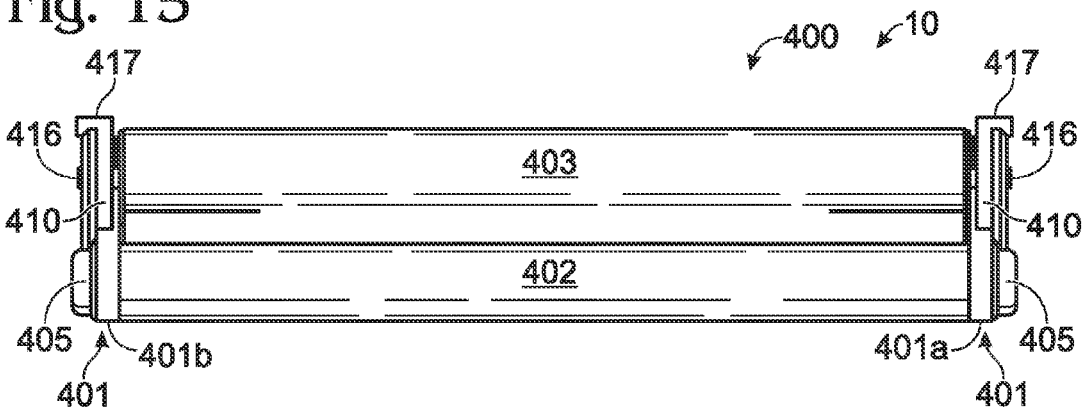
FIG. 15 is front elevation view of a fourth embodiment of a cigarette rolling device.
Figure 16:
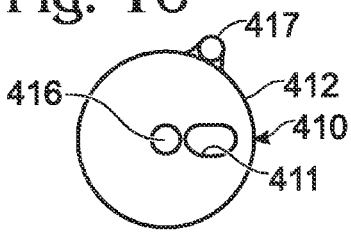
FIG. 16 is an elevation view of a guard plate of the device of FIG. 15.
Figure 17:
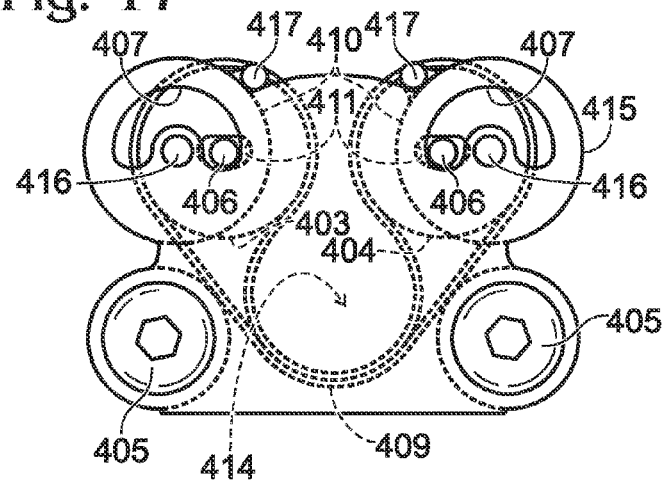
FIG. 17 is a side elevation view of the device of FIG. 15 in a closed configuration.
Figure 18:
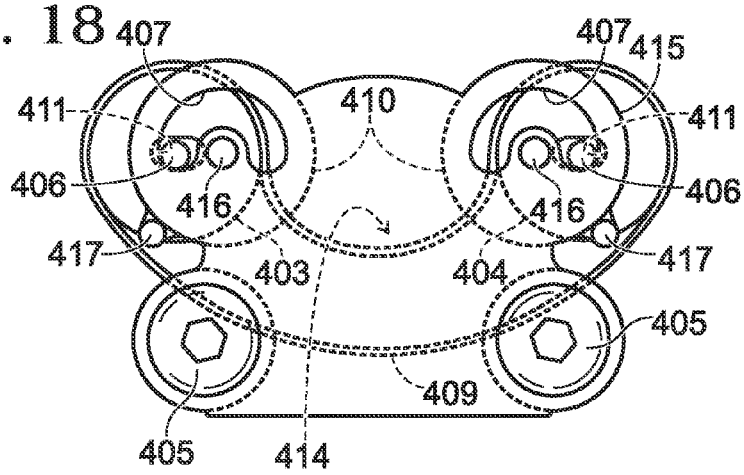
FIG. 18 is a side elevation view of the device of FIG. 15 in an open configuration.

Device 400 includes, for each cylinder 403, 404, a pair of guard plates 410 disposed at either end of the cylinder, between the end of the cylinder and the corresponding support plate. Somewhat similar to the embodiment 200, device 400 includes a mount 416, such as an axle portion or a recess, to rotatably mount each guard plate to the support plate. Guard plates 410 each include a movement slot 411 through which axle portions 406 of the cylinders extend, and are also each shown to include a thumb lever 417 protruding from the peripheral edge 412 of the guard plate. As can be seen in FIG. 15, thumb levers 417 extend distally over a portion of the support plates. In this configuration, the peripheral edge 412 of the guard plates is flush with the peripheral edge 415 of the support plates. As such, the distal extension of thumb levers 417 over a portion of the support plates may assist a user in manipulating the cylinders by means of moving the thumb levers.

The operation of device 400 is similar to that of device 200, in that movement of a thumb lever 417 around the curved edge of the corresponding support plate rotate the guard plate 410 from which the thumb lever extends, and rotation of the guard plate effects movement of the corresponding cylinder by means of the movement slot 411 carrying the axle portion 406 of the cylinder along the curvilinear slot. Loose tobacco may be loaded, and compressed into a tobacco rod, by moving the cylinders to the appropriate positions to adjust the shape of the recess 414.

Figure 19:
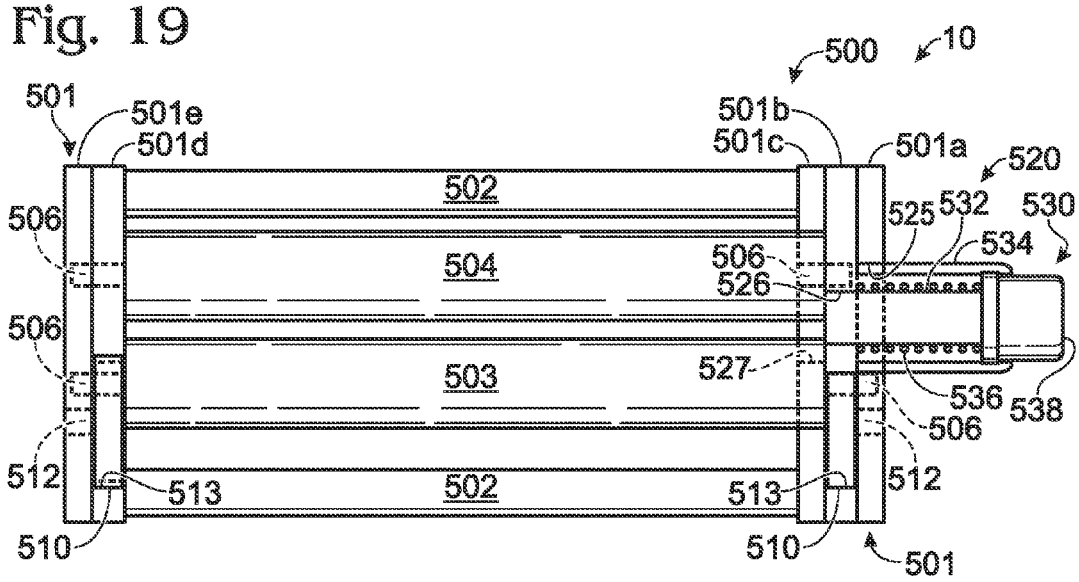
FIG. 19 is a top view of a fifth embodiment of a cigarette rolling device, which includes a folding device that includes an impinger assembly, with some portions of the device shown in partial cross-section.
Figure 20:
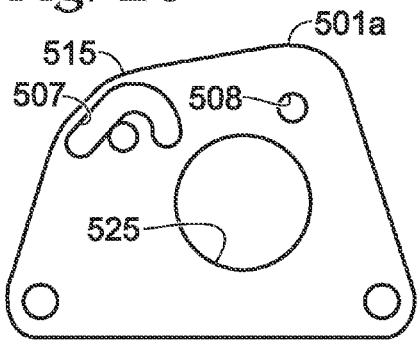
FIG. 20 is an elevation view of a support plate layer of a support plate of the device of FIG. 19.
Figure 21:
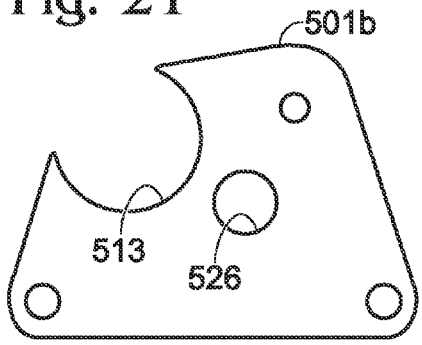
FIG. 21 is an elevation view of another support plate layer of a support plate of the device of FIG. 19.

A fifth illustrative embodiment 500 of a cigarette rolling device is shown in FIGS. 19-25. FIG. 19 is a top view with a partial cross-section of device 500, which includes support plates 501 extending from a base portion 502 that interconnects the support plates at anchor points 505 (shown in FIG. 23).

As will be discussed, the embodiment 500 includes a somewhat more complex configuration as compared with the previously discussed illustrative embodiments. For example, the support plates 501 are shown as assemblies of several support plate layers, although it is certainly within the scope of this disclosure that the support plates may each be of monolithic, as opposed to composite, construction, or of a composite construction different that that shown in the drawings. As a matter of simplicity, each support plate layer is indicated in the drawings with a different reference number (i.e., 501*a*, 501*b*, 501*c*, and so forth), and the support plate layers that collectively form each support plate are indicated (and referred to herein) generally at 501.

With additional reference to FIGS. 20-23, two cylinders 503, 504 extend between and are rotatably mounted to the support plates by means of axle portions 506 that are either seated within a mounting site 508 (shown as a hole) or journaled in curvilinear slots 507. This embodiment includes only one moveable cylinder 503, and a pair of guard plates 510 on either end of cylinder 503 that are seated in recesses 513 on the support plates 501 (or, more specifically, on support plate layers 501*b* and 501*d*). Guard plates include movement slots 511, and also partially protrude beyond the peripheral edges 515 of the support plates and include a knurled surface (not shown), such that the guard plates may be used as thumbwheels for movement of the cylinder 503 toward and away from cylinder 504. A looped belt 509 is trained around the cylinders, the portion between the cylinders forming a recess 514 for receiving (when the cylinder 503 is spaced from cylinder 504) and shaping (when the cylinder 503 is moves to be substantially adjacent to cylinder 504) a quantity of loose tobacco.

Figure 22:
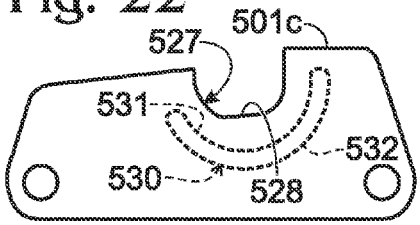
FIG. 22 is an elevation view of yet another support plate layer of a support plate of the device of FIG. 19.
Figure 23:
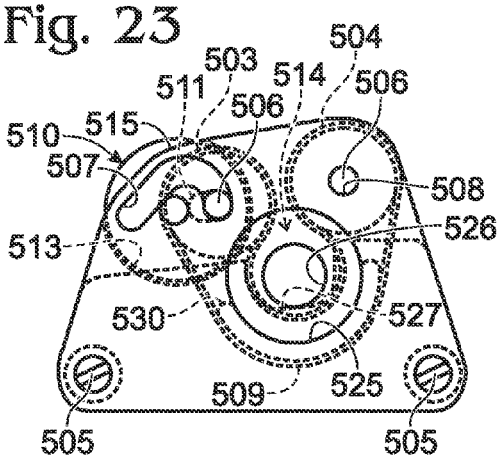
FIG. 23 is side elevation view of the device of FIG. 19 in a closed configuration.

As can be seen in FIGS. 22 and 23, embodiment 500 includes a trough 530 extending between and interconnecting the support plates 501 (or, more specifically, on support plate layers 501*c* and 501*d*). The trough is shown to have a U-shaped, or semicircular, cross-section, with a first, or inner, surface 531, and a second, or outer, surface 532. One layer of belt 509 is shown to be trained around the outer surface of the trough, which is thus disposed between the portion of the belt forming the recess and the portion surrounding the recess portion.

The trough may facilitate efficient use of the device, for example, by reducing drag. In the illustrative embodiments previously discussed, the portion of the belt that forms the recess may be urged toward, or even against, the other layer of the belt that moves in the opposite direction of the portion forming the recess, when a quantity of loose tobacco is being shaped in the recess via rolling of the belt. FIGS. 5, 10, 14, and 17 illustrate such a configuration. In such configurations, the additional belt layer may provide some degree of support when the loose tobacco is being compressed in the recess. The inner surface of the belt may further have a texture to reduce the amount of friction generated when portions of the surface slide or contact each other.

However, in some circumstances, the inner surface of the belt that slides against itself when the two layers are moved in opposite directions may eventually become worn from repeated use, and/or create drag that interferes with rolling, due to two surfaces moving relative to each other. Moreover, moisture or loose tobacco particles may cause layers of the belt to bind or otherwise adhere to each other, pulling both layers in the same direction, which may lead to binding of the cylinders, creasing or tearing the belt, or other mechanical interference or damage to the device.

Also, distensions or other irregularities in the belt surface may in turn lead to uneven rolling of a leaf of cigarette paper around a shaped tobacco rod, or create creases and folds in a leaf of cigarette paper, which many users may find undesirable.

The trough may thus reduce or prevent drag by providing a stable sliding surface for one layer of the belt, or otherwise preventing the portion of the belt forming the recess from rubbing or sliding against, or otherwise contacting, other portions of the belt, such as a layer of the belt moving in the opposite direction when the belt is rolled. Further, the stable surface provided by the trough may reduce or prevent distension of the belt when rolling a leaf of cigarette paper around a tobacco rod, resulting in a smooth paper surface.

As mentioned briefly above, a quantity of loose tobacco is compressed and shaped into a tobacco rod by rolling the belt, as the tension of the belt itself, in addition to forces urging the tobacco against surfaces over which the belt is moved. The trough may function to increase the tension of the belt (or reduce slack) overall or when the cylinders are in the closed configuration, by providing another surface around which the belt is trained. Increasing the tension of the belt may in turn provide stability to the device and/or increase consistency of cigarettes produced using the device by positionally stabilizing the cylindrical recess formed when the cylinders are in the closed configuration. In such configurations, only the portion of the belt trained around the outer surface of the trough may come in contact with the trough.

In some configurations, such as those in which the portion of the belt forming the recess comes in contact with a trough (such as the inner surface of the trough), the trough may facilitate forming of a tobacco rod by providing support surface against which the tobacco in the recess may be urged when the belt is moved over the cylinders (or rolled around the rollers). The roller surfaces and the surface tension of the unsupported portion of the belt itself collectively provide a compressive force on the tobacco in the cylindrical recess, but repeated use over time may tend to stretch the belt so that the surface tension is weakened, or the belt is slackened sufficiently, and so forth, so that the belt may become unsuitable for compressing tobacco. As such, the support trough in such configurations may provide a support surface against which the belt may be urged, which may reduce or even prevent distension of the belt via the compressive force delivered to the tobacco in the recess by the cylinders.

Optionally, the trough may function to establish the diameter of a finished cigarette, such as by providing a support surface of constant diameter, and/or by increasing the tension of the belt surface, as discussed above, either of which may assist a user in determining the correct quantity of loose tobacco to use. By reducing or preventing variation in the diameter of tobacco rod shaped in the device, a user can be assured of relatively consistent results, which may in turn reduce waste of leaves of paper if the tobacco rod produced is too large for a standard leaf to surround.

The trough may thus have any configuration, shape, thickness, cross-section, and so forth, suitable to achieve any of the aforementioned results. For example, alternative configurations may include a flatter or more curved cross-section than that shown (i.e., a semi-circular cross section with a different diameter), be a different thickness, and so forth, as well as be of composite construction and/or discontinuous construction.

The trough may, in some configurations, and in conjunction with other components of the cigarette rolling devices disclosed herein, such as that of a folding device, facilitate compression or otherwise shaping of the ends of the tobacco rod, and/or fold the edge of a leaf of cigarette paper rolled around a tobacco rod inward, such as to prevent the tobacco from falling out of the finished cigarette and/or to form one end into a smoking end.

Embodiment 500 includes a folding device disposed on one of the support plates that is configured to engage and fold the edge of a piece of paper received between the cylinders and rolled around the tobacco rod. FIG. 19 shows folding device 520 disposed on one of support plates 501, which is configured to engage and fold the edge of a leaf of cigarette paper received between the rollers and rolled around a tobacco rod shaped in the cylindrical recess.

The folding devices of the present disclosure may take a variety of forms and configurations, three illustrative types, and variants thereof, are discussed in the following paragraphs and embodiments. Alternative embodiments to those disclosed herein may, of course, include folding devices that incorporate components and subcomponents of one or more of these illustrative types, and such variations are considered to be within the scope of this disclosure.

In the illustrated example embodiment 500, folding device 520 is shown to further include a first illustrative type of folding device in the form of an impinger assembly, generally designated at 530, shown mounted on support plate 501 relative to an opening 526. In particular, impinger assembly 530 is shown to be mounted on support plate layer 501*b*, and to extend in a distal direction through an aperture 525 on support plate layer 501*a*. The impinger assembly is shown to include an impinger element 532 that is selectively actuable to reversibly project through the opening 526 (and generally into recess 514, as discussed in more detail below). More specifically, impinger assembly 530 is shown to include a shell 534 housing a biasing element 536, shown as a spring coiled around impinger element 532, which biases a button 538 in a distal direction.

Figure 24:
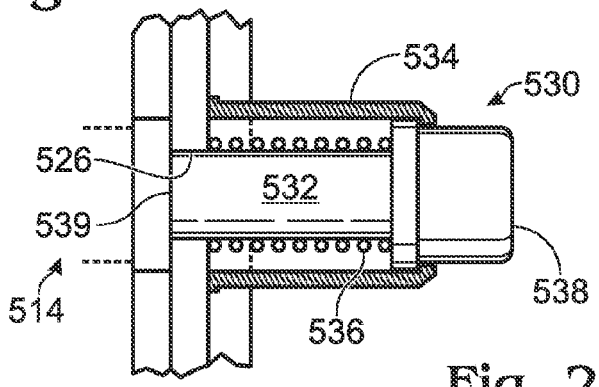
FIG. 24 is a partial cross-sectional view of the impinger assembly of the device of FIG. 19.
Figure 25:
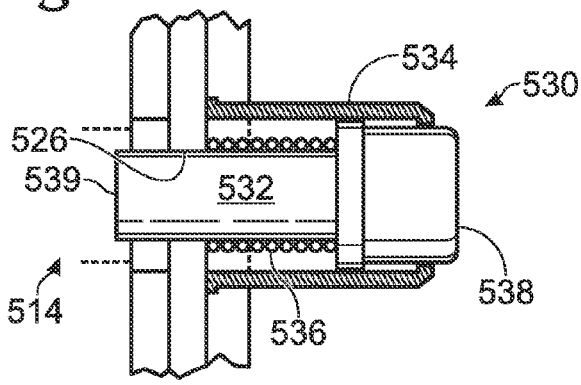
FIG. 25 is another partial cross-sectional view of the impinger assembly of the device of FIG. 19, showing how the impinger element may be projected.
Figure 26:
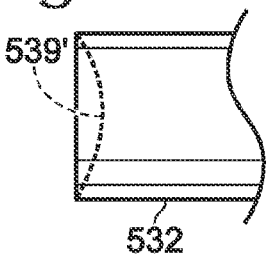
FIG. 26 is a partial cross-sectional view of a first alternative configuration of the impinger element of the device of FIG. 19.
Figure 27:
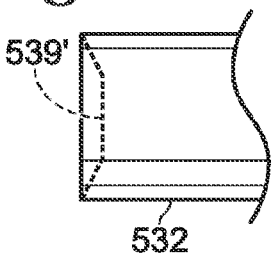
FIG. 27 is a partial cross-sectional view of a second alternative configuration of the impinger element of the device of FIG. 19.

FIGS. 24 and 25 are partial cross-section detail views of the impinger assembly 530 illustrated in FIGS. 19-23, and illustrate its operation. Opening 526 is aligned with respect to the substantially cylindrical recess formed by the belt when the rollers are in a "closed" configuration (indicated schematically at 514) such that the impinger element may be at least partially projected into the recess. As such, it can be seen that button 538 is operably connected to impinger element 532 such that urging the button in a proximal direction (that is, toward the device) projects the impinger element 532 through the opening and partially into the recess 514, as seen by comparing FIG. 24 with FIG. 25. Thus, when a tobacco rod, or a tobacco rod around which a leaf of cigarette paper has been at least partially rolled, is positioned in the cylindrical recess, the impinger element (or, as illustrated, an engaging face 539 of the impinger element) will engage the end of the tobacco rod and/or a portion of the edge of the piece of paper rolled around the tobacco rod. When the button is released, the biasing element 536 urges the impinger element in a distal direction, that is, out of and in a direction away from the cylindrical recess.

An example of the operation of a device that incorporates a folding device in the form of an impinger assembly includes first rolling a quantity of loose tobacco in the cylindrical recess when the cylinders are moved to a "closed" configuration, as discussed in detail above, and then inserting a leaf of cigarette paper into the device in order to wrap the shaped tobacco rod in the paper to form a cigarette.

The impinger assembly may then be used to compress or "tap" the end of the tobacco rod, and/or to engage and fold inward the edge of the piece of paper as, and/or after, it has been rolled around the tobacco rod. In other words, a user may use the impinger assembly prior to inserting the paper, for example to compress lengthwise the tobacco at the end of the tobacco rod, and then again while rolling the paper. In the latter technique, a user may opt to use the impinger assembly several times while rolling the paper, such as by incrementally advancing the paper and engaging the impinger element between incremental advances, such as to fold each section of paper over separately. Or, a user may simply opt to engage the impinger once at the end of the paper rolling phase.

The configuration of an impinger assembly, when incorporated into a cigarette rolling device, may thus take any desired form suitable to the application. For example, the impinger assembly may be configured to project an impinger element to any desired extent into the cylindrical recess, or even have a depth that is adjustable by a user. The impinger element itself, and/or the engaging face thereof, may have a desired geometric configuration, which may relate to the function performed by the impinger assembly.

For example, an impinger element with a planar face and a comparatively small diameter relative to the diameter of the cylindrical recess may function primarily to "tap" or longitudinally compress the end of a shaped tobacco rod, and/or urge any paper folded toward the tobacco rod against the end of the tobacco rod, whereas an impinger element with a diameter closer to, or even greater than, that of the cylindrical recess may more readily engage the edge of a piece of paper rolled around the tobacco rod, such as to fold the paper inward over the tobacco and/or urge the paper against the tobacco. As a matter of convenience, an impinger element (or a portion thereof) that is adapted to longitudinally compress the tobacco rod may be referred to herein as a "compression element." As such, the face of the impinger element itself may function as a compression element, or a compression element may be a separate component or section of the impinger assembly or folding device.

"Tapping" or compressing the end of a shaped tobacco rod may more securely pack the tobacco into a cylindrical form, making the tobacco rod less likely to break apart and/or to reduce or even prevent loose tobacco from flaking away or otherwise coming loose from the tobacco rod. Such compression may thus allow a cigarette to last longer in storage, without tobacco coming loose from the end of the cigarette. Compression of one or both ends of a tobacco rod may also provide a flat surface against which cigarette paper, or the end of a cigarette tube, may be folded, such as to hold tobacco in the paper or tube while the cigarette is being held, stored, or smoked, and/or simply for aesthetic effect.

As shown in FIGS. 19 and 23-25, the impinger element 532 is configured, when projected, to project along an axis that is substantially coaxial with the long axis of the substantially cylindrical recess 514 formed when the cylinder 503 is in a "closed" position. However, some embodiments may include an impinger element configured to project along a parallel, offset (or noncoaxial) axis relative to the cylindrical recess. Some embodiments optionally may include an impinger element configured to project into the cylindrical recess at an angle relative to the cylindrical axis. In the latter configurations, the face of the impinger element may be positioned to more easily engage the edge of the paper than an impinger element oriented to project into the central axis of the tobacco rod.

Optionally, the face of the impinger element that is adapted to engage the tobacco rod and/or the edge of the cigarette paper may be shaped to direct, deflect, and/or fold the edge of a piece of paper so engaged. An impinger element with a face that is at least partially concave, as shown at 539' in FIG. 26, or inwardly cone-shaped, as shown at 539' in FIG. 27, for example, may facilitate inward folding of the edge of a piece of tobacco paper.

Figure 28:
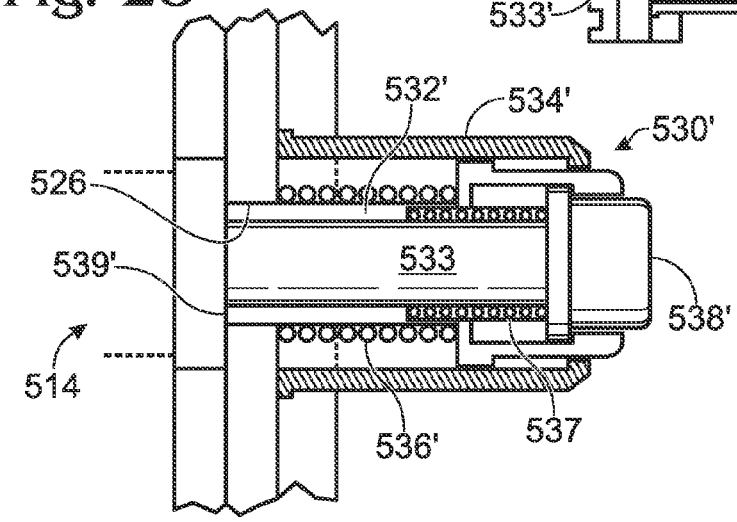
FIG. 28 is a partial cross-sectional view of an alternative configuration of the impinger assembly of the device of FIG. 19.

An impinger assembly may incorporate one or more of these concepts, such as by incorporating a shaped face and also including a compression element. Further, such a compression element may be configured to selectively project from the face of the impinger element in a two-stage process, such as after, before, or while the impinger element is projected into the cylindrical assembly. An alternative configuration that incorporates such a two-stage impinger assembly is shown in FIG. 28 as impinger assembly 530'. The configuration is shown to include a telescoping shell 534' that houses an impinger element 532' and a biasing element 536' that biases a button 538' in a distal direction. Impinger element 532' further houses a compression element 533 that may extend from the face 539' of the impinger element when button 538' is pressed, via a second biasing element 537. The relative configuration and/or resistance of the biasing elements within shell 534' may be such that when button 538' is first depressed, the impinger element extends into recess 514, for example to initially fold or otherwise deflect the engaged end of a piece of cigarette paper rolled around a tobacco rod, and further depression of button 538' prompts the projection of compression element 533 from the face 539' of the projected impinger element, for example to compress the tobacco at the end of the tobacco rod and/or urge the deflected or folded paper against the end of the tobacco rod. In other alternative configurations, the arrangement of the biasing elements and/or other internal structural components may be such that depression of the button 538' may generate the aforementioned actions in a different order, overlapping, or simultaneously, as desired.

The impinger elements disclosed thus far are shown to include substantially circular cross-sections. However, as mentioned briefly above, the cross-section of the substantially cylindrical recess formed by a belt trained over the cylinders of the cigarette rolling devices of the present disclosure may be somewhat teardrop-shaped, with the narrow end of the teardrop corresponding to the area between the rollers. Such an arrangement may, in some embodiments, result in an unevenly rolled cigarette, because the leading edge of a leaf of cigarette paper rolled around a shaped tobacco rod may, once rolled partially around the rod, then be oriented in a direction outward in between the cylinders, or in other words be directed tangentially from the perimeter defined by the cylinder formed by the substantially cylindrical recess. Continued rolling of the paper may thus result in advancing the leading edge of the paper in a tangential direction and back toward the cylinders before being engaged by a cylinder and directed back around the tobacco rod.

Figure 29:
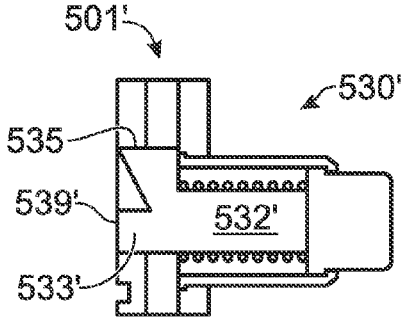
FIG. 29 is a partial cross-sectional view of another alternative configuration of the impinger assembly of the device of FIG. 19.
Figure 30:
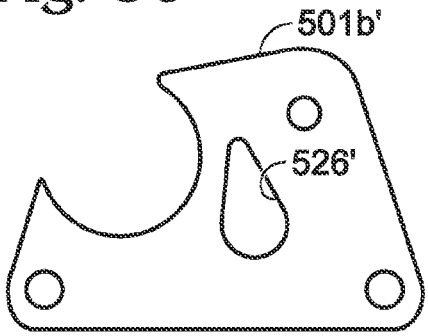
FIG. 30 is an elevation view of a support plate layer suitable for use with the alternative configuration of the impinger assembly of FIG. 29.
Figure 31:
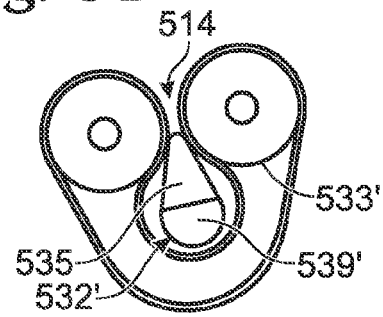
FIG. 31 is an elevation view of a portion of a cigarette rolling device suitable for use with the alternative configuration of the impinger assembly of FIG. 29.

Another alternative configuration 530' of an impinger assembly is shown in FIGS. 29-31 to include an impinger element 532' that includes a horn 535, which projects longitudinally from the face 539' of the impinger element. The horn is positioned, when the impinger assembly is engaged and the impinger element is projected into the cylindrical recess, to engage and deflect inward the edge of a piece of paper that is outside the perimeter defined by the substantially cylindrical recess. As such, although such a configuration is not required to all embodiments, at least a portion of the impinger element 532' has a teardrop-shaped cross-section, as shown in FIG. 30, and the opening 526' in the support plate upon which the impinger assembly 530' is mounted (or, more specifically, support plate layer **501*b*') is shown to be correspondingly shaped. As can be seen in FIG. 31, the horn 535 is positioned with respect to the substantially cylindrical recess 514** to engage and deflect inward the edge of a piece of paper outside the perimeter defined by the recess, such as a piece of paper that is at least initially moving in a tangential direction back toward the space between the cylinders as the paper is being advanced through the device and rolled around a tobacco rod.

The structural configuration of the horn may be fashioned as desired. For example, the face of the impinger that tapers toward the horn may be curved or planar, or the face may have another regular or irregular shape, as desired to guide the edge of a deflected piece of paper inward toward the tobacco rod.

The alternative configuration 530' in FIGS. 29-31 is also shown to include a compression element 533' disposed on the face 539' of the impinger element 532'. If the horn is positioned at the "top" of the teardrop cross-section, the impinger element 532' may be said to be positioned at the "bottom", and as such is disposed to compress a portion of the end of a tobacco rod shaped in the recess, urging any paper between the portion of the face separate from the horn and the tobacco rod, toward the tobacco rod, folding the edge of the paper.

As mentioned briefly above, the trough may facilitate "finishing" of a rolled cigarette, such as in conjunction with a folding device in the form of an impinger assembly, for example by providing a stable support or tensioning device to maintain the shaped tobacco rod for proper alignment with the impinger device.

A second illustrative type of a folding device is referred to herein as a deflection plate. In addition, or as an alternative, to an impinger assembly, a folding device may include one or more deflection plates that may be disposed on a support plate and configured to engage, guide, and deflect inward an edge of a leaf of cigarette paper at least partially rolled around a tobacco rod.

An example of a deflection plate is shown in FIGS. 22 and 23 at 527. Support plate layer 501*c* includes a deflection plate in the form of a curved surface that generally follows the curve defined by the inner surface of the trough 530, but incorporates a flat region 528. As can be seen in FIG. 19, support plate 501*c* is the innermost member of the support plate 501 to which the impinger assembly 530 is mounted, and is shaped such that as a paper is received between the rollers and rolled around a tobacco rod, the edge of the paper is guided along the curved surface of deflection plate 527 until it engages the flat region 528, which deflects the guided edge of the paper inward toward the tobacco rod, as the paper is further rolled.

In the example embodiment 500 of cigarette rolling device 10 shown in FIGS. 19-23, the edge of the cigarette paper thus deflected may then be engaged by the impinger assembly 530, such as to fold the deflected edge firmly against the tobacco rod. However, alternative configurations of a folding device may include only a deflection plate. Further, the configuration of the deflection plate may vary from embodiment to embodiment.

Figure 32:
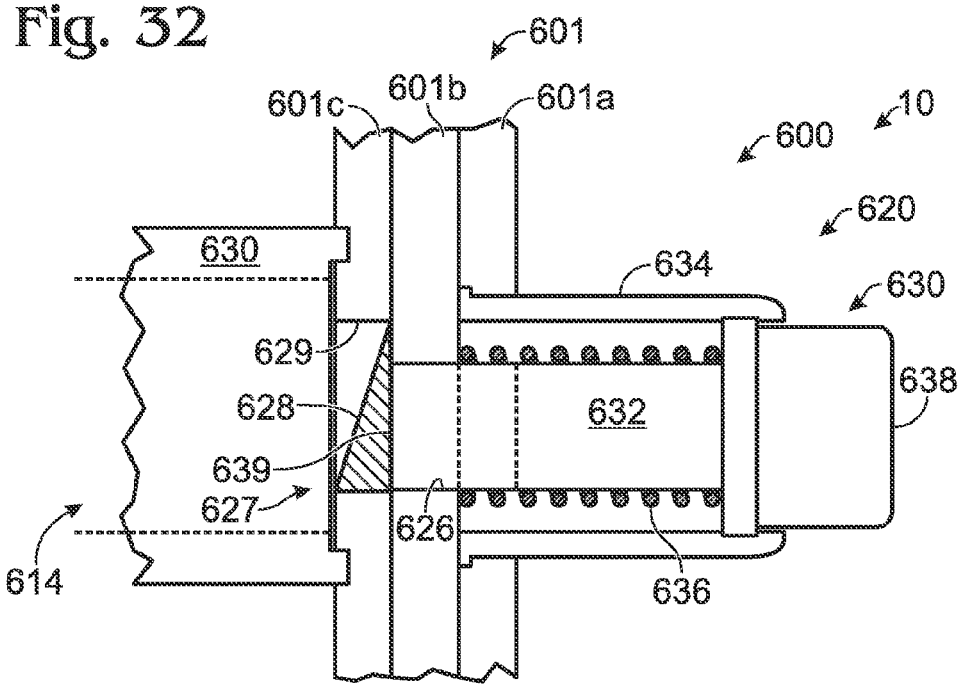
FIG. 32 is a partial cross-sectional view of a sixth embodiment of a cigarette rolling device, which includes a folding device that includes an impinger assembly and a deflection plate.
Figure 33:
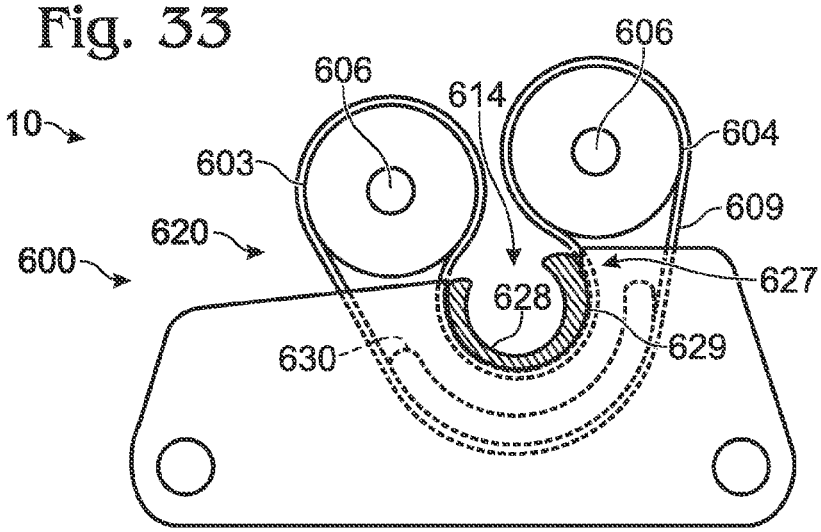
FIG. 33 is an elevation view of a portion of the device of FIG. 32, showing the deflection plate and other components of the device.

For example, another configuration of a deflection plate is shown in a sixth illustrative embodiment 600 of a cigarette rolling device 10, which is partially illustrated in FIGS. 32 and 33. For brevity, many of the components of embodiment 600 are not shown in the drawings, but for the purposes of clarity, the general configuration of embodiment 600 may be assumed to be similar to embodiments previously discussed herein, in terms of incorporating two rotatably mounted cylinders, one of which is moveable in order for a looped belt trained around the cylinders to selectively form a cylindrical recess adapted to shape a quantity of loose tobacco into a tobacco rod.

FIG. 32 shows a partial cross-sectional top view of a support plate 601 to which is mounted a folding device 620 that includes both an impinger assembly 630 and a deflection plate 627. Support plate 601 is shown as a composite structure consisting of support plate layers 601*a*, 601*b*, and 601*c*. Impinger assembly 630 is shown to include an impinger element 632 housed within a shell 634 that also includes a button 638 biased by a biasing element 636, in a similar configuration to that shown in device 500.

As can also be seen in FIG. 33, which shows support plate layer 601*c*, cylinders 603, 604, a trough 630, and a belt 609 trained around the trough and over the cylinders to form a recess 614, the deflection plate 627 includes a shaped surface 628 that is defined by a peripheral edge 629. As shown, the peripheral edge 629 of the deflection plate corresponds to the inner surface of recess 614. In other words, the belt and rollers in embodiment 600 are configured such that the cylindrical recess 614 aligns with the peripheral edge 629 of the deflection plate 627. Optionally, although not shown in this view, the trough may be positioned to provide a curved surface to ensure alignment of the peripheral edge 629 with the cylindrical recess formed by the belt.

As shown best in FIG. 32, the shaped surface 628 of the deflection plate is helical relative to, and partially recessed within, the plane of the support plate upon which the deflection plate is disposed. As such, as a leaf of cigarette paper is received between rollers 603, 604 and rolled around a tobacco rod in the cylindrical recess 614, the peripheral edge 629 of the deflection plate 627 guides an edge of the paper along the shaped surface 628 as the paper is rolled around the tobacco rod, thereby deflecting the guided edge inward toward the tobacco rod as the paper is further rolled.

With configurations of folding devices that include deflection plates such as those shown in illustrative embodiments 500 and 600, the engaging surface or surfaces of the deflection plate may apply a torsional load to the cigarette paper while the edge is guided along the peripheral edge of the deflection plate, due to the angle of contact and friction of the edge of the paper in contact with the forming (deflection) plate, but the size and shape of the surface may be configured to reduce or eliminate this effect, making for a gentle fold. Thus, alternative embodiments may include a helical or spiral surface in which the angle of the deflection increases, decreases, otherwise varies, or stays constant (as shown in FIGS. 32 and 33) along the length of the peripheral edge.

The impinger assembly 630 is shown to be somewhat similar to that shown in previously discussed embodiments; however, the axis along which the impinger element 632 is configured to project is shown to be parallel to, and non-coaxial with (or, in other words, offset from) the long axis of cylindrical recess 614. As such, the edge of the cigarette paper that is guided and deflected inward by the deflection plate may also be engaged by the impinger assembly 630, such as to fold the deflected edge firmly against the tobacco rod.

A third illustrative type of a folding device is referred to herein as a plurality of crimping elements. In addition, or as an alternative, to an impinger assembly and/or a deflection plate, a folding device may include a plurality of crimping elements adapted to project into the cylindrical recess from angles transverse to the long axis of the recess, to engage and inwardly crimp the edge of a piece of cigarette paper at least partially rolled around a tobacco rod.

Figure 34:
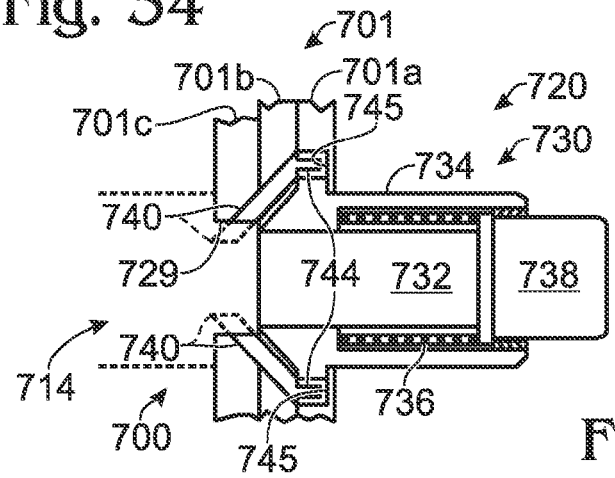
FIG. 34 is a partial cross-sectional view of a seventh embodiment of a cigarette rolling device with a folding device that includes an impinger assembly and a plurality of crimping elements.
Figure 35:
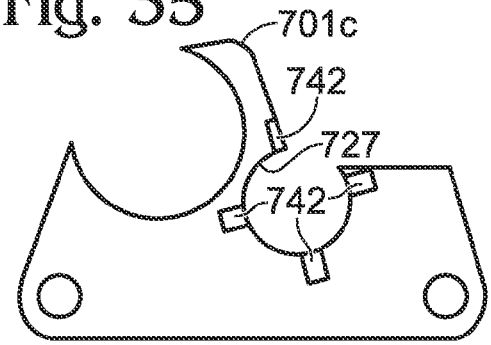
FIG. 35 is an elevation view of a support plate layer of a support plate of the device of FIG. 34.

An illustrative embodiment that incorporates such a feature is partially shown in FIGS. 34-39. FIG. 34 shows a portion of a support plate 701 for an embodiment 700 of a cigarette rolling device in partial cross-section. As with embodiment 600, for brevity, many of the components of embodiment 700 are not shown in the drawings, but for the purposes of clarity, the general configuration of embodiment 700 may be assumed to be similar to embodiments previously discussed herein, in terms of incorporating two rotatably mounted cylinders, one of which is moveable in order for a looped belt trained around the cylinders to selectively form a cylindrical recess adapted to shape a quantity of loose tobacco into a tobacco rod. In FIGS. 34-39, embodiment 700 is shown to include a folding device 720 having both an impinger assembly and a plurality of crimping elements 740 that are adapted to reversibly project into a substantially cylindrical recess (indicated at 714) formed by a belt (not shown). More particularly, FIGS. 34 and 35 show that a support plate layer 701*c* includes an opening 727 aligned with cylindrical recess 714 and including a peripheral edge configured to accept the edge of a piece of paper received between two cylinders (not shown), and guide it around the opening as the paper is further rolled around the tobacco rod, such that the edge of the paper is positioned to be engaged by crimping elements 740 when projected.

Figure 36:
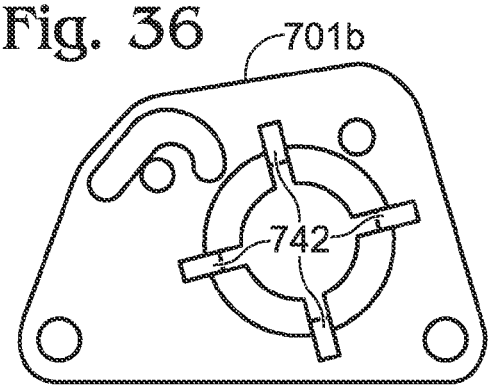
FIG. 36 is an elevation view of another support plate layer of a support plate of the device of FIG. 34.

Crimping elements 740 are shown to be disposed within a corresponding plurality of recesses 742, which are adapted to house the crimping elements when not projected. As shown in FIGS. 34-36, recesses 742 are disposed at an angle of approximately 45 degrees with respect to the longitudinal axis of the cylindrical recess. The mechanism by which the crimping elements may be extended, or projected, may be performed by any suitable configuration, but is shown in the example embodiment to utilize other components of the folding device 720, and more particularly, elements of impinger assembly 730 of the folding device.

Figure 37:
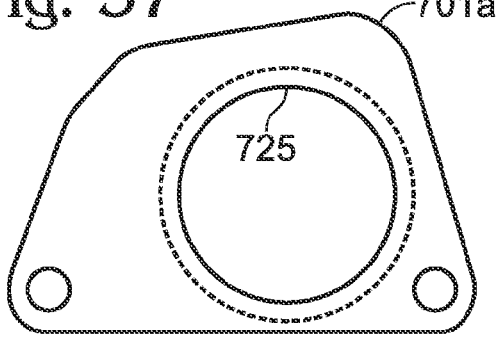
FIG. 37 is an elevation view of yet another support plate layer of a support plate of the device of FIG. 34.

Impinger assembly 730 is shown mounted on support plate 701 relative to an opening 725 and includes, somewhat analogously to impinger assemblies of other embodiments discussed herein, an impinger element 732 selectively actuable to reversibly project through the opening, via a shell 734 that includes a button 738 and a biasing element 736. FIG. 37 shows support plate layer 701*a*, which is shown to include opening 725 to which impinger assembly 730 is mounted. However, the impinger assembly 730 is mounted so that shell 734 is rotatable, as discussed in greater detail below.

Figure 38:
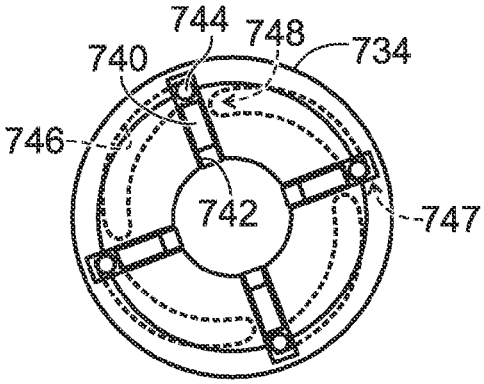
FIG. 38 is a cross-sectional view of a portion of the impinger assembly of the device of FIG. 34.

As shown in FIGS. 34 and 38, each crimping element 740 is further shown to include a foot or tab 744. As shown in FIG. 38, which shows a cross-sectional view of the proximal portion of shell 734, the foot 744 of each crimping element is positioned against a floor surface 745 of a curved guide channel 746 that has a progressively shallower depth as the channel leads from an outer end 747 to an inner end 748. Shell 734 is rotatable about a central axis in a range of movement determined by the arc of the guide channels, relative to the plurality of recesses 742.

In operation, rotating the shell moves the curved guide channels, urging the foot of each crimping element along the length of the channel. Due to the ramped floor surface of the guide channels (i.e., each channel becoming shallower from the outer to the inner end), the crimping elements are extended into cylindrical recess 714 when the shell is rotated in one direction (shown in FIG. 34 as dashed structures 740), and recessed back into the recesses 742 when the shell is rotated in the opposite direction (shown in FIG. 34 as solid structures 740).

FIG. 34 also shows that support plate layer 701*c* includes a recessed portion defined by a peripheral edge 729. Peripheral edge 729 may be adapted to guide an edge of a piece of paper generally around the recessed portion as the paper is rolled around the tobacco rod, such that the paper is aligned in the recess relative to the recesses 742 so that the crimping elements, when projected, engage the edge of the paper within the recessed portion of the support plate.

In operation, then, it can be seen that as a leaf of cigarette paper is rolled at least partially around a tobacco rod in embodiment 700, a user may rotate shell 734 to project crimping elements into the cylindrical recess to engage and inwardly crimp the edge of the paper.

Further, folding device 720 also includes an impinger assembly 730, which may be deployed by a user in combination with the crimping elements, to urge the crimped edge portions further inward against the tobacco rod.

The crimping elements in alternative embodiments consistent with this disclosure may take any configuration suitable to achieve the aforementioned result. As such, embodiments of cigarette rolling devices with folding devices that include crimping elements may include a plurality of any number of such elements, configured to extend into the cylindrical recess at any desired angle transverse to the axis of the recess. For example, other embodiments may include six crimping elements rather than four, or any other number. Further, some or all of the crimping elements may be adapted to engage the edge of a cigarette paper rolled around a tobacco rod at right angles or otherwise, instead of at approximately 45 degrees, as illustrated. Alternative configurations of the crimping elements may include engaging portions that are shaped as desired, and the extent to which all or some of the elements project into the cylindrical recess may similarly be configured as suitable for the application; some configurations may include crimping elements that extend into the recess to a maximum depth that may be adjusted by the user.

Further, the mechanism for extending and retracting the crimping elements may be configured as suitable for the embodiment. For example, in the embodiment partially illustrated in FIGS. 34-38, rotating a component of an impinger assembly functions to project and retract the crimping elements, but in embodiments that do not incorporate such a component, any suitable actuating device, such as a switch, lever, button, and so forth, may be configured to generate the result of selectively projecting the crimping elements to engage and inwardly crimp the edge of a piece of paper at least partially rolled around a tobacco rod.

In embodiments that incorporate a folding device that includes an impinger assembly as well as crimping elements, such as the example embodiment shown in FIGS. 34-38, the edge of the cigarette paper that is crimped inward by the crimping elements may also be engaged by the impinger assembly, such as to fold the deflected edge firmly against the tobacco rod. In the illustrated embodiment, the end of the cigarette may be "finished" by selective operation of both the crimping elements and the impinger device, such as by intermittent crimping and compressing while the paper is being rolled around the tobacco rod. Incorporating the deployment mechanism for the crimping elements into the impinger device may thus facilitate such operation by allowing a user to perform both actions by alternately rotating the shell to extend and retract the crimping elements, and pressing the button to project the impinger element.

Thus far, the illustrative embodiments of cigarette rolling devices 10 have included means by which a leaf of cigarette paper may be rolled around, and at least partially folded or compressed against, a tobacco rod that is shaped in a recess formed by the movement of the belt over the rollers.

In addition or as an alternative to cigarette papers, which typically come in books of packets of flat leaves, pre-formed cigarette tubes are also commercially available, for example if a user prefers to hand-roll a tobacco rod, but does not want to roll a leaf of cigarette paper around the tobacco rod. Some commercially available cigarette tubes also include filter tips positioned within the otherwise empty tube, into which a user may place a shaped tobacco rod.

Thus, as an alternative to a folding device, embodiments of a cigarette rolling device may instead include a mechanism by which a tobacco rod shaped in the cigarette rolling device, as explained in detail above, may be pushed or injected into a pre-formed cigarette tube.

An illustrative example of such an embodiment, which may be thought of as a cigarette forming device, is shown at 800 in FIGS. 39-47. As with other embodiments discussed herein, device 800, a top view of which is shown in FIG. 38, includes support plates 801 (which consist of support plate layers 801*a-f*, shown in FIGS. 40-45) extending from a base portion 802 interconnecting the support plates. With additional reference to FIGS. 42 and 45, two cylinders 803, 804 extend between and are rotatably mounted to the support plates by means of axle portions (not shown) that are either seated within a mounting site 808 (shown as a hole) or journaled in curvilinear slots 807. This embodiment includes only one moveable cylinder 803, and a pair of guard plates 810 on either end of cylinder 803 that are seated in recesses 813 on the support plates 801 (or, more specifically, on support plate layers 801*d* and 801*e*, shown in FIGS. 43 and 44, respectively). As with previously discussed embodiments, the guard plates include movement slots, and also partially protrude beyond the peripheral edges 815 of the support plates such that the guard plates may be used as thumbwheels for movement of the cylinder 803 toward and away from cylinder 804. A looped belt (not shown) is trained around the cylinders, the portion between the cylinders forming a recess for receiving (when the cylinder 803 is spaced from cylinder 804) and shaping (when the cylinder 803 is moves to be substantially adjacent to cylinder 804) a quantity of loose tobacco. The looped belt is also trained around the outer surface of a trough 830 positioned with respect to the belt so that the inner surface of the trough is aligned with the portion of the belt forming the substantially cylindrical recess when the rollers are in a "closed" configuration.

Figure 39:
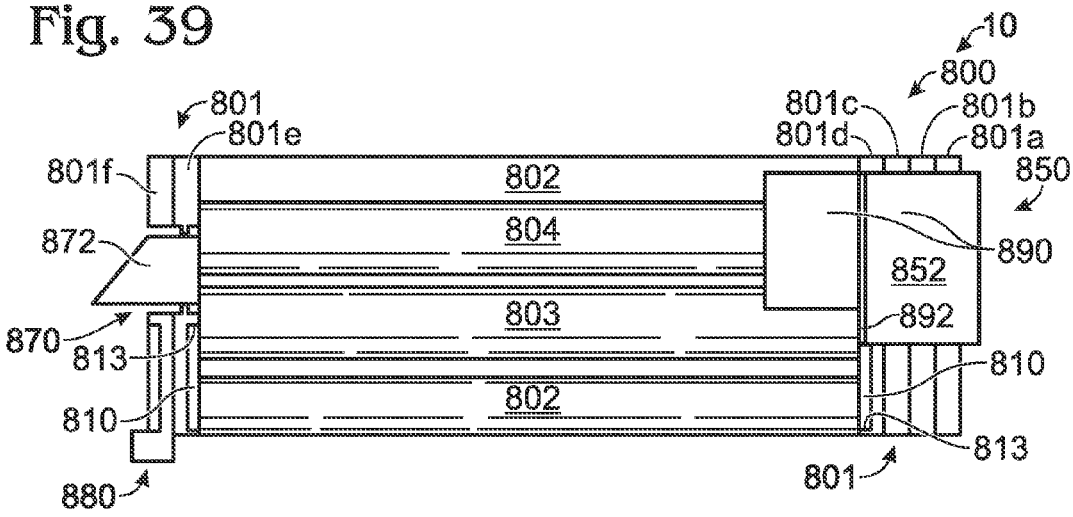
FIG. 39 is a top view of an eighth embodiment of a cigarette rolling device, which includes a pushing device.
Figure 40:
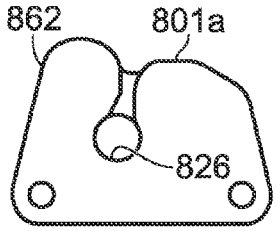
FIGS. 40-45 are elevation views of support plate layers of the support plates of the cigarette rolling device of FIG. 39.
Figure 41:
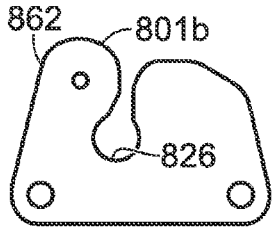
Figure 42:
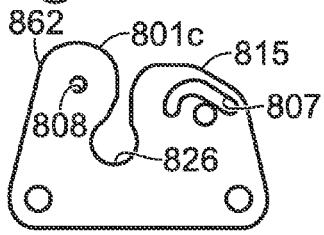
Figure 43:
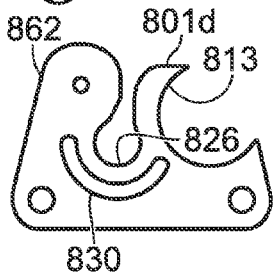
Figure 44:
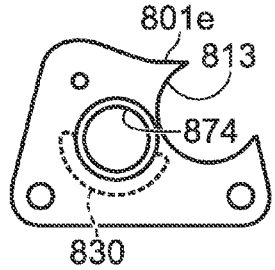
Figure 47:
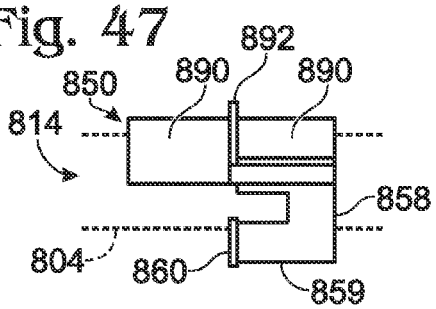
FIG. 47 is another elevation view of the pushing device of the device of FIG. 39.
Figure 46:
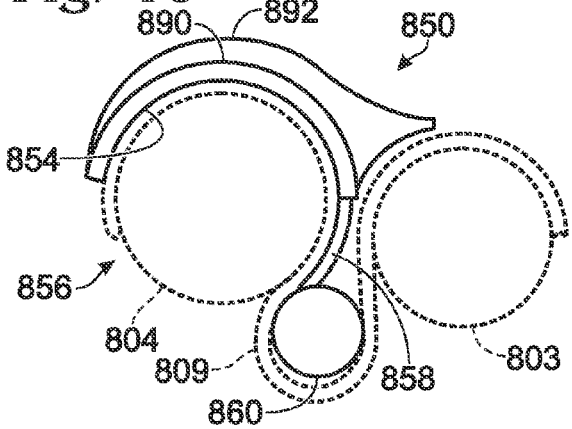
FIG. 46 is an elevation view of the pushing device of the device of FIG. 39.

As shown in FIG. 39, device 800 further includes a pushing device 850 mounted for movement relative to the cylinders, along an axis parallel to the cylinders. Pushing device 850 includes an outer surface 852 and as shown in FIGS. 46 and 47, an inner surface 854, the inner surface further including a collar portion 856 which is shaped to removably clamp to cylinder 804 to retain the pushing device on the cylinder, but to also allow slidable movement of the sliding device therealong. The outer surface is shown in FIG. 39 to include two generally flat portions 890 separated by a central ridge 892; the illustrated configuration may provide for ease of slidable movement, for example, by a user's thumb or index fingers, but the outer surface may have any suitable configuration.

As shown in FIGS. 46 and 47, an arm 858 is shown to extend from the collar portion in a direction such that when pushing device is mounted on cylinder 804, the arm descends generally into a recess 814 formed by the portion of the belt 809 trained around the cylinders.

An extension 859 protrudes at a right angle from the arm and terminates in a substantially circular pushing surface 860. So configured, the pushing surface is adapted to engage and push the end of a shaped tobacco rod in the cylindrical recess, by sliding the pushing device along the cylinder. More particularly, the pushing device is adapted to be slid toward one support plate, arbitrarily designated as a "first" support plate, from the direction of the other, "second" support plate, and back again. In other words, if the pushing device is initially positioned near the second support plate, when a tobacco rod is shaped in the cylindrical recess, sliding the pushing device toward the first support plate will engage the pushing surface with the end of the tobacco rod and push the end of the tobacco rod toward the first support plate, to longitudinally compress the tobacco rod.

As mentioned above, "tapping" or compressing the end of a shaped tobacco rod may more securely pack the tobacco into a cylindrical form, making the tobacco rod less likely to break apart and/or to reduce or even prevent loose tobacco from flaking away or otherwise coming loose from the tobacco rod. As such, longitudinal compression may allow a cigarette to last longer in storage, without tobacco coming loose from the end of the cigarette. Compression of one or both ends of a tobacco rod may also provide a flat surface against which cigarette paper, or the end of a cigarette tube, may be folded, such as to hold tobacco in the paper or tube while the cigarette is being held, stored, or smoked, and/or simply for aesthetic effect.

The collar portion and inner surface 854 are configured to move in a short range of rotatable movement about the cylinder to which the device 850 is clamped, such as to ensure stability of the pushing device on the cylinder 804. More specifically, as cylinder 803 is moved from a "closed" position to an "open" position, the portion of the belt trained between the cylinders moves from defining a relatively deeper, cylindrical recess to defining a broader, relatively shallower recess. As this belt portion moves from one configuration to the other, it pushes against the portion of the pushing device within the recess (i.e., the pushing surface 860 and/or the extension 859). However, the collar portion and inner surface of the pushing device are configured to allow the pushing device to "rock" back and forth on the cylinder, for example to accommodate the movement of the belt when the cylinders are moved between "open" and "closed" configurations, without becoming detached therefrom.

In the illustrated embodiment, the second support plate is configured to receive and house at least a portion of the pushing device, such as to allow the pushing device to be moved substantially out of the recess while a quantity of loose tobacco is being shaped into a tobacco rod, so as not to interfere with the rolling process. The second support plate thus includes a recess, generally indicated as shaped openings 826 in support plate layers 801*a-d*, and a peripheral surface that includes a sliding portion, consisting collectively of the slide surfaces 862 on support plate layers 801*a-d*. The sliding portion is configured to be flush with at least a portion of cylinder 803, so that the pushing device may be selectively at least partially moved, or slid, from the cylinder onto the second support plate. Such a movement recesses arm 858, and at least a portion of extension 859, into the recess formed by openings 826. As such, the pushing device may be selectively moved to the support plate, housing a portion thereof within the recess in the support plate, so that after a tobacco rod is formed, the pushing device may be deployed to urge the pushing surface against the end of the tobacco rod.

As such, in some embodiments, a pushing device as configured as shown in FIGS. 39 and 46-47 may function as a compression element, as discussed above with respect to embodiment 500 and variations thereof, such as to longitudinally compress the tobacco rod.

However, embodiment 800 of a cigarette rolling device is also shown to include an opening 870 in the first support plate, and a nozzle 872 disposed on the support plate that extends through the opening. The nozzle has a circular cross-section and is positioned on the support plate to be aligned with the substantially circular recess formed by the belt 809 when the rollers are in a "closed" configuration, such that the contents of the cylindrical recess (such as a shaped tobacco rod) may be pushed through the opening, and the nozzle, when the pushing device is slid from the second support plate toward the first support plate. In the illustrated embodiment, the nozzle is shown to be mounted to the support plate by means of a retaining rim 874 on support plate layer 801*e*, but any suitable mounting method may be used.

The size of the cross-section of the nozzle is such that an end of pre-formed cigarette tube (not shown) may be fitted over the nozzle and retained against the support plate. As such, after a quantity of loose tobacco has been shaped into a compressed tobacco rod in the substantially cylindrical recess formed by the belt, sliding the pushing device from the second support plate toward the first support plate functions to engage the pushing surface with the end of the tobacco rod and urges the tobacco rod through the opening 870 and nozzle 872, and into the cigarette tube retained against the first support plate, to form a cigarette.

Also, in the illustrated configuration of the pushing device, sliding the pushing device to the extent of the movement allowed by the first support plate partially projects the pushing surface 860 partially through the opening, by means of extension 859 on arm 858. When the length of the cylinders corresponds to the length of the cigarette tube, this configuration thus may allow the tobacco rod, once injected into the cigarette tube, to be further compressed or "tapped" into the tube.

Optionally, of course, the pushing device may be used to push bits of loose tobacco from the belt, for example to clean the belt of the device between uses.

Figure 45:
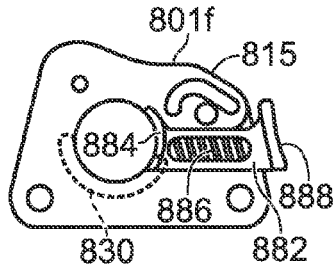

The embodiment 800 is also shown to include a clamping device 880 that is selectively operable to retain a tube on the nozzle. Although any suitable configuration may be used, clamping device 880 is shown in FIG. 45 to include a rod 882 housed within support plate layer 801*f*, the rod terminating at one end in a clamping surface 884 that is shaped to hold an end of the tube against the exterior surface of the nozzle 872. Rod 882 is biased away from nozzle 872 by means of an internal biasing element 886, such that pressing a button 888 at the other end of rod 882 urges the clamping surface 884 against the nozzle 874, securing a cigarette tube in place, such as for receiving a tobacco rod from the device 800.

The above descriptions, embodiments, and various configurations and variants thereof are intended to be illustrative, and not restrictive. Many other embodiments will be apparent to those of skill in the art upon reviewing the above description. The scope of the inventions disclosed herein should, therefore, be determined with reference to the appended claims, along with the full scope of equivalents to which such claims are entitled. While the above discussion of cigarette rolling devices 10 that incorporate features such as guard plates, movable cylinders, troughs, pushing devices, folding devices including one or more of impinger assemblies, deflection plates, and crimping elements, and so forth, are discussed in a illustrative embodiments, it should be understood that the devices described are equally implemented in other combinations of elements not explicitly described but within the capability of one of skill in the art.

Accordingly, while embodiments of cigarette rolling devices 10 have been particularly shown and described with reference to the foregoing disclosure, many variations may be made therein. Various combinations and sub-combinations of features, functions, components, concepts, elements and/or properties may be used. Such variations, whether they are directed to different combinations or directed to the same combinations, whether different, broader, narrower or equal in scope, are also regarded as included within the subject matter of the present disclosure. The foregoing embodiments are illustrative, and no single feature or element is essential to all possible combinations that may be claimed in this or later applications. The claims, accordingly, define selected embodiments disclosed in the foregoing disclosure. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. A cigarette forming device comprising:

a base with first and second support plates extending therefrom; first and second parallel cylinders extending between the support plates and rotatably mounted thereto, the first cylinder further being translatably moveable between a first position in which the first cylinder is spaced from the second cylinder, and a second position in which the first cylinder is substantially adjacent to the second cylinder;

a looped belt trained around the cylinders, wherein the portion of the belt between the cylinders forms an open recess adapted to receive a quantity of loose tobacco when the first cylinder is in the first position, and wherein the portion forms a substantially cylindrical recess in which the tobacco may be shaped into a tobacco rod when the first cylinder is rolled in the second position;

a pushing device slidably coupled to the first or second cylinder and configured for movement along an axis parallel to the cylinders, the pushing device including a pushing surface adapted to engage and push one end of a shaped tobacco rod in the cylindrical recess toward the first support plate.

2. The cigarette forming device of claim 1, wherein the first support plate further includes an opening and a nozzle disposed thereon, the nozzle extending in a direction away from the cylinders and being configured to receive and retain one end of a pre-formed tube against the plate; and wherein the pushing device is adapted to selectively push the tobacco rod from the recess into a tube into a tube retained on the nozzle.

3. The cigarette forming device of claim 2, further including a clamping device selectively operable to retain a tube on the nozzle.

4. The cigarette forming device of claim 2, wherein the pushing device is adapted to selectively move the pushing surface at least partially through the opening.

5. The cigarette forming device of claim 1, wherein the pushing device further includes a collar portion adapted for slidable movement along one of the cylinders, the collar portion including an arm extending therefrom and generally into the recess formed by the portion of the belt between the cylinders, and wherein the pushing surface is disposed on the arm.

6. The cigarette forming device of claim 5, wherein the pushing device further includes an extension disposed on the arm, the extension extending in the direction of movement of the pushing device, and wherein the pushing surface is disposed on the end of the extension.

7. The cigarette forming device of claim 5, wherein one of the support plates includes a recess, and wherein the pushing device is adapted to selectively move at least the arm of the pushing device into the recess.

8. The cigarette forming device of claim 5, wherein the collar portion is configured to removably clamp to the cylinder for slidable movement thereon.

9. The cigarette forming device of claim 8, wherein the collar portion is configured to move in a range of rotatable movement about the cylinder.

10. The cigarette forming device of claim 5, wherein the second support plate includes a sliding portion configured such that the pushing device is adapted to be selectively and at least partially moveable from the cylinder to the sliding portion of the support plate.

11. The cigarette rolling device of claim 1, wherein the support plates include a pair of corresponding slots; wherein the first cylinder includes axle portions protruding from each end of the cylinder, each axle portion being journaled in one of the slots for slidable movement therein; and further including a guard plate disposed between one end of the first cylinder and the slot in which the axle portion protruding from the end of the first cylinder is journaled, the guard plate being configured to prevent loose tobacco from the recess from entering the slot.

12. The cigarette rolling device of claim 1, further including a trough extending between and interconnecting the support plates, the trough having a top surface and a bottom surface; and wherein the looped belt is trained around the cylinders and the trough;

wherein the recess is formed by a portion of the belt between the cylinders; and wherein the trough is adapted to prevent the portion of the belt forming the recess from contacting other portions of the belt.

13. A cigarette forming device comprising:

a base with first and second support plates extending therefrom; first and second parallel cylinders extending between the support plates and rotatably mounted thereto, the first cylinder further being translatably moveable between a first position in which the first cylinder is spaced from the second cylinder, and a second position in which the first cylinder is substantially adjacent to the second cylinder;

a looped belt trained around the cylinders, wherein the portion of the belt between the cylinders forms an open recess adapted to receive a quantity of loose tobacco when the first cylinder is in the first position, and wherein the portion forms a substantially cylindrical recess in which the tobacco may be shaped into a tobacco rod when the first cylinder is rolled in the second position; and a pushing device mounted for movement along an axis parallel to the cylinders, the pushing device including a pushing surface adapted to engage and push one end of a shaped tobacco rod in the cylindrical recess toward the first support plate, wherein the pushing device further includes a collar portion adapted for slidable movement along one of the cylinders, the collar portion including an arm extending therefrom and generally into the recess formed by the portion of the belt between the cylinders, and wherein the pushing surface is disposed on the arm.

14. The cigarette forming device of claim 13, wherein the pushing device further includes an extension disposed on the arm, the extension extending in the direction of movement of the pushing device, and wherein the pushing surface is disposed on the end of the extension.

15. The cigarette forming device of claim 13, wherein one of the support plates includes a recess, and wherein the pushing device is adapted to selectively move at least the arm of the pushing device into the recess.

16. The cigarette forming device of claim 13, wherein the collar portion is configured to removably clamp to the cylinder for slidable movement thereon.

17. The cigarette forming device of claim 16, wherein the collar portion is configured to move in a range of rotatable movement about the cylinder.

18. The cigarette forming device of claim 13, wherein the second support plate includes a sliding portion configured such that the pushing device is adapted to be selectively and at least partially moveable from the cylinder to the sliding portion of the support plate.

19. A cigarette forming device comprising:

a base with first and second support plates extending therefrom; first and second parallel cylinders extending between the support plates and rotatably mounted thereto, the first cylinder further being translatably moveable between a first position in which the first cylinder is spaced from the second cylinder, and a second position in which the first cylinder is substantially adjacent to the second cylinder;

a looped belt trained around the cylinders, wherein the portion of the belt between the cylinders forms an open recess adapted to receive a quantity of loose tobacco when the first cylinder is in the first position, and wherein the portion forms a substantially cylindrical recess in which the tobacco may be shaped into a tobacco rod when the first cylinder is rolled in the second position;

a pushing device mounted for movement along an axis parallel to the cylinders, the pushing device including a pushing surface adapted to engage and push one end of a shaped tobacco rod in the cylindrical recess toward the first support plate; and a trough extending between and interconnecting the support plates, the trough having a top surface and a bottom surface; and wherein the looped belt is trained around the cylinders and the trough;

wherein the recess is formed by a portion of the belt between the cylinders; and wherein the trough is adapted to prevent the portion of the belt forming the recess from contacting other portions of the belt.

* * * * *